US006467893B1

(12) United States Patent
Matsumoto et al.

(10) Patent No.: US 6,467,893 B1
(45) **Date of Patent: *Oct. 22, 2002**

(54) METHOD AND APPARATUS FOR FORMING IMAGE WITH PLURAL COATING LIQUIDS

(75) Inventors: Nobuo Matsumoto, Kanagawa (JP); Ryoichi Yamamoto, Kanagawa (JP); Hideo Ishizaka, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/472,974

(22) Filed: Dec. 28, 1999

(30) Foreign Application Priority Data

Dec. 28, 1998 (JP) ..... 10-374663

(51) Int. Cl.[7] ..... B41J 2/17; B41J 2/135; B41J 2/02

(52) U.S. Cl. ..... 347/98; 347/43; 347/73

(58) Field of Search ..... 346/140.1; 347/98, 347/110, 21, 15, 103, 73, 43, 35

(56) References Cited

U.S. PATENT DOCUMENTS

| | | | | |
|---|---|---|---|---|
| 3,416,153 A | | 12/1968 | Hertz et al. | |
| 3,946,398 A | | 3/1976 | Kyser et al. | |
| 4,109,282 A | | 8/1978 | Robertson et al. | 347/98 X |
| 4,490,728 A | | 12/1984 | Vaught et al. | |
| 4,538,160 A | * | 8/1985 | Uchiyama | 347/98 X |
| 5,099,256 A | * | 3/1992 | Anderson | 347/103 |
| 5,646,656 A | * | 7/1997 | Leonhardt et al. | 347/43 |
| 5,777,636 A | * | 7/1998 | Naganuma et al. | 347/15 X |
| 6,126,267 A | * | 10/2000 | Ito et al. | 347/35 |
| 6,299,286 B1 | * | 10/2001 | Matsumoto et al. | 347/43 |

FOREIGN PATENT DOCUMENTS

| | | | | |
|---|---|---|---|---|
| EP | 0 739 742 A2 | | 10/1996 | |
| JP | 61-32757 A | * | 2/1986 | 347/98 |
| JP | 63-291663 | | 11/1988 | |
| JP | 5-4335 A | * | 1/1993 | 347/103 |

* cited by examiner

*Primary Examiner*—John Barlow
*Assistant Examiner*—Manish S. Shah
(74) *Attorney, Agent, or Firm*—Birch, Stewart, Kolasch & Birch, LLP

(57) ABSTRACT

An image forming method and apparatus for forming an image on an image receiving medium with plural coating liquids. A plurality of types of coating liquid are combined to form a recording liquid and extruded as a continuous flow from an array of plural extruding ports which are aligned in a direction substantially orthogonal to a relative movement direction of the image receiving medium. While a mixing ratio of the plural coating liquids is varied based on an image signal, the recording liquid is continuously applied on the image receiving medium to form the image thereon. The high-speed image formation is enabled with a reduced amount of ink to be wasted. Preferably, the plurality of types of the coating liquid are not equally mixed but can be superimposed in the form of a layer in the coating thickness direction to be continuously applied.

32 Claims, 15 Drawing Sheets

METHOD AND APPARATUS FOR FORMING IMAGE WITH PLURAL COATING LIQUIDS

BACKGROUND OF THE INVENTION

1. Field of the Invention

The present invention relates to an image forming method and apparatus for generating a recording fluid having a predetermined density and/or a predetermined color by changing a proportion or mixing ratio of plural coating liquids based on an image signal, and leading the thus-obtained recording fluid to an image receiving medium to form an image.

2. Description of the Related Art

U.S. Pat. No. 3,416,153 (which will be referred to as a prior art reference 1, hereinafter) discloses an image forming method, in which a series of charged ink droplets having predetermined intervals is caused to pass through an electric field modulated by an image signal. Unnecessary ink droplets are deflected to be removed and desired ink droplets are selectively guided to a recording sheet so as to form an image on the recording sheet. Since the ink droplets are continuously ejected or jetted in this system, this is referred to as a continuous ink jet system.

U.S. Pat. No. 3,946,398 (which will be referred to as a prior art reference 2, hereinafter) discloses a recording method, in which a piezoelectric transducer plate is deformed by a modulation of an image signal to push out the ink. The pushed-out ink droplets are jetted or expelled from an orifice to be impacted on a recording medium. This system is referred to as a piezo ink jet system.

U.S. Pat. No. 4,490,728 (which will be referred to as a prior art reference 3, hereinafter) discloses another recording method, in which the ink is rapidly expanded or vaporized by heat of a heater modulated by an image signal. The rapidly-expanded ink gas or vapor is used to jet the ink liquid from an orifice to be impacted on a recording medium. Since ink droplets are jetted by using heat, this is referred to as a thermal ink jet system.

U.S. Pat. No. 4,109,282 (which will be referred to as a prior art reference 4) discloses a printing device, in which a valve called a flap valve is provided in a flow path for leading two types of liquid, i.e., clear ink and black ink into a substrate for forming an image. The flow path for each ink is opened/closed by displacement of this valve so that the two types of liquid are mixed in a desired density to be transferred onto the substrate. This enables printout of an image having the gray scale information which is the same with that of the image information displayed on a TV screen.

This reference 4 discloses that a voltage is applied between the flap valve and an electrode provided on a surface opposed to the flap valve and the valve itself is mechanically deformed by the electrostatic attracting force to cause displacement of the valve. Further, the ink is absorbed in paper by a capillary action which acts on the ink between a tip of the flap valve and fibers of the print paper.

Unexamined Japanese Patent Publication (KOKAI) No. 291663/1988 (which will be referred to as a prior art reference 5, hereinafter) discloses a coating method, in which two types of thick (dark) and thin (light) liquid are mixed in a coating head to be continuously extruded from a slot-opening opposed to a running web. Thus, the mixed liquid is consecutively coated on the web. In this coating method, the mixed liquid is coated over the entire coating width with a uniform coating membrane pressure without forming a residue deposit, and the coating liquid having a density graduation in time course is continuously applied with respect to a traveling direction of the web. In addition, this method enables coating with a uniform thickness with respect to the width direction.

Accordingly to the method disclosed in the prior art reference 1 (the continuous ink jet system), unnecessary ink droplets are removed by modulating the electric field to enable drawing of a desired image. However, it is required to provide each mechanism for independently modulating the electric field for each nozzle provided for each pixel, thereby making it difficult to reduce the dimension of each nozzle. It is also hard to form multiple nozzles with a high density in accordance with pixels. Only a part of continuously jetted ink droplets must be used for forming an image, and hence this mode is not suitable for high speed recording because many ink droplets are not used but removed. Moreover, since the ink is continuously jetted, a large amount of ink is wasted, and the obtained is thus expensive.

According to the method disclosed in the prior art reference 2 (the piezo ink jet mode), a desired image can be drawn by jetting only ink droplets which are used for forming an image. Jetting only a necessary amount of ink eliminates the waste of ink, and a relatively-inexpensive print can be obtained. However, the nozzles must be arranged in the high density for realizing the high quality of an image, leading to a problem where the image is distorted by the interaction of the ink droplets jetted from adjacent nozzles.

According to the method disclosed in the prior art reference 3 (the thermal ink jet mode), an arbitrary image can be drawn and jetting only a necessary amount of ink can obtain a relatively-inexpensive print as similar to the above-mentioned piezo ink jet mode. However, when the nozzles are provided in the high density for realizing the high quality of an image, the image is distorted by the interaction of the jetted ink droplets. Additionally, in the above prior art references 1–3, since the droplets are jetted onto image receiving paper at high speed, a part of the ink droplets smashes by impact to form an ink mist. Such ink mist cannot be captured on the image receiving paper. The uncaptured ink mist leaks to the installation environment of the printer to pollute the environment which is pointed out as a problem.

According to the method disclosed in the prior art reference 4, the ink extruded from the nozzle is directly applied on the paper. Therefore, in a case where the paper has a large thickness or irregularity on the surface of the paper, it is difficult to reproduce an image on the paper with fidelity with respect to the electric signal. Accordingly, this method is not done in practical use, as yet. Further, since the ink to be used is restricted to two types, a color image cannot be recorded. Furthermore, since the ink is drawn out by the capillary action between the ink and the fibers of the paper in this mode, the ink tends to be affected by the quality of the paper and a change in quality of the paper involves a change in quality of an image. Moreover, the image cannot be truly reproduced due to the partial irregularity of the fiber structure even if the paper with the same quality is used.

According to the coating method disclosed in the prior art reference 5, although an image having a density graduation along a traveling direction of a web which is a target of coating can be formed, the image cannot have a density graduation along a width direction of the web (a direction orthogonal to the web traveling direction). Consequently, application of the coating liquid whose color or density changes for each pixel in accordance with an image signal is impossible.

SUMMARY OF THE INVENTION

The present invention has been accomplished under the circumstances as aforementioned, and a first object thereof is to provide an image forming method by which: a high-quality image can be formed at high speed; a coating liquid cannot be wastefully used; reduction in dimension of a nozzle is possible; an installation environment cannot be adversely affected; influence of a thickness, a state of a surface or an undulatory surface of a final image receiving medium such as paper or irregularity of the fiber structure of the same can be eliminated; and an image can be stably formed.

Further, it is a second object of the present invention to provide an image forming apparatus which is directly used for implementing this method.

According to the present invention, the first object can be attained by an image forming method for forming an image on an image receiving medium with plural coating liquids, comprising the steps of;

a) providing an array of plural extruding ports aligned in a direction substantially orthogonal to a relative movement direction of the image receiving medium;

b) combining said plural coating liquids extruded in each of the plural extruding ports to form a recording liquid and extruding said recording liquid from each of said plural extruding ports, a mixing ratio of said plural coating liquids in the recording liquid being varied based on an image signal; and c) transferring said recording liquid to said image receiving medium as a continuous flow while said image receiving medium is moved relatively to said aligned plural extruding ports;

whereby said recording liquid constituted by the plural coating liquids is continuously applied on said image receiving medium to form the image.

Plural coating liquids may be mixed homogeneously to form the recording liquid to be coated on the image receiving medium, such as a recording sheet or a temporary (intermediate) image receiving medium. Preferably, however, the recording liquid is not homogeneous mixture of the plural coating liquids. Rather, the recording liquid has layer construction of a laminar flow of the plural coating liquids. Specifically, the plural coating liquids extruded from the respective extruding ports may be continuously applied to the image receiving medium in a direction of a thickness of coating in the superimposed manner without homogeneously mixing the coating liquids.

The extruding ports may be provided in accordance with respective pixel to be aligned in a direction of the width of an image receiving medium (a direction substantially orthogonal to a relative-displacement direction). Thus aligned plural extruding ports may be formed in a slot-shaped opening, and the coating liquids extruded from each extruding ports associated with each pixel are integrated and zonated in the slot-shaped opening along the width direction. The zonated composite liquid of coating liquids can be thereby applied on the image receiving medium.

At least one of the plural coating liquids may be clear liquid which is substantially transparent or becomes substantially transparent when dried out. A density of pixels in the coated image can be controlled by a proportion or mixing ratio of this clear liquid and non-clear coating liquid. The non-clear coating liquid is a liquid different from the clear liquid and has an optical density. In this case, by maintaining a volume flow rate of the coating liquids to a substantially-fixed value, the flow of the coating liquids can be smoothed to prevent the image quality from being reduced. Furthermore, at least one clear liquid may be fed at a substantially constant feed pressure irrespective of an image signal. The extrusion amount of this clear liquid can be controlled to be changed by controlling an extrusion amount of the other coating liquid(s) to be mixed or combined with this clear liquid. As properties of multiple types of the coating liquid to be used, it is preferable that these types of the coating liquid are superimposed or laminated to be applied in a direction of the coating thickness, and those having small differences in characteristics at least in viscosity, specific gravity, surface tension and temperature are desirable. The superimposed state cited above includes the state in which the adjacent two types of the coating liquid are mixed with a range of a minute distance from a border.

In multiple types of the coating liquid extruded in the superimposed or laminated manner, the coating liquid in at least one outermost layer may be a clear liquid which is or becomes substantially transparent when dried out. With such an arrangement, the influence of irregularity of the surface state and the like of the image receiving medium can be eliminated to improve the image quality by using this clear liquid as undercoating liquid coming into contact with the surface of the image receiving medium.

The image receiving medium may be an intermediate image receiving medium, such as a transfer drum, holding the composite layers of the coating liquids temporarily and then transferring the composite layers to a final image receiving medium such as recording sheet. In this case, the undercoating liquid in the outermost layer of the composite layers comes into contact with the surface of the intermediate image receiving medium, and then comes into contact with the top surface of the final image when transferred to the final image receiving medium.

On the contrary, the undercoating liquid may be superimposed so as to be the uppermost layer when applied on the intermediate image receiving medium. When transferred to the final image receiving medium, the undercoating liquid is brought into contact with the surface of the image receiving medium and undercoats the surface. Further, when coating by using the intermediate image receiving medium, arrangements are made so that the coating liquids can smoothly transfer to the final image receiving medium when the temporary formed image on the intermediate image receiving medium is transferred to the final image receiving medium. For example, adhesion between the intermediate image receiving medium and the coating liquid establishing contact therewith or cohesion in this coating liquid is so set as to be smaller than cohesion in or between other types of coating liquid or adhesion between the final image receiving medium and any other coating liquid establishing contact therewith.

When adjacent extruding ports are biased each other in a direction which is not orthogonal to the relative displacement direction of the image receiving medium, a distance between adjacent pixels can be narrowed to improve the image quality. In this case, the distortion or deviation of pixels in recorded image can be compensated by changing the clock timing of the image signal in accordance with an amount of bias of the adjacent extruding ports.

The flow of the coating liquids can be stabilized by always extruding the coating liquids from the respective extruding ports during a period in which no image is formed or recorded. The coating liquid which is unnecessary for formation of an image is removed and collected during the transfer from the respective extruding ports to the image receiving medium.

According to the present invention, the second object can be attained by an image forming apparatus for forming an image on an image receiving medium with plural coating liquids, comprising:

a recording head having an array of plural extruding ports aligned in a direction substantially orthogonal to a relative movement direction of the image receiving medium, the respective extruding ports extruding the plural coating liquids and combining the plural coating liquids extruded to form a recording liquid, the recording liquid being transferred to the image receiving medium as a continuous flow while the image receiving medium is moved relatively to said aligned plural extruding ports;

extrusion amount controlling means for controlling an amount of supply of said plural coating liquids fed to said respective extruding ports; and a controller for controlling a mixing ratio of said plural coating liquids in the recording liquid based on an image signal and determining a supply amount and supply timing of the respective coating liquids, the determined supply amount and supply timing being fed to said extrusion amount controlling means;

whereby said recording liquid having the mixing ratio of the plural coating liquids based on the image signal is continuously applied on the image receiving medium to form the image.

The extrusion amount controlling means may be formed by an extrusion amount control valve provided in a passage extending from a feed path for supplying the coating liquid to the respective extruding ports. For example, it may be a diaphragm valve using a piezoelectric device. This extrusion amount control valve is provided for each pixel aligned in a direction of the width of the recording head and controls a quantity of flow by any of or combination of an opening, an opening time and a number of times of opening. Further, the extrusion amount controlling means may be formed by a pump whose quantity of extrusion is variable. This pump can be constituted by, for example, a piezoelectric device provided for each pixel aligned in a direction of the width of the recording head and a one-way valve. In this case, a quantity of flow is controlled by any of or combination of an operating speed, an operating time and a number of times of operation of the pump.

The plurality of coating liquids, needless to say, may be all separately controlled by an extrusion control valve comprising a control valve or a pump, but part of the coating liquid which is always extruded, for example, the clear liquid may be fed at a substantially constant pressure irrespective of an image signal. In this case, the feeding amount of the clear liquid which is fed at the substantially constant pressure is decreased or increased in accordance with the increase or decrease of the extrusion amount of the other coating liquid. That is to say, the total flow rate of all the coating liquids substantially depends on a diameter of a coating liquid extruding port, and hence, the extrusion amount of the clear liquid can automatically be controlled by the extrusion amount of the other coating liquid. In consequence, the number of the extrusion amount control means which are disposed on a recording head can be reduced, so that the constitution of the recording head can be simplified.

The plural extruding ports may be provided in accordance with each of the pixels aligned in a direction of the width of the image receiving medium.

The plural extruding ports may be divided into groups so that the respective groups corresponds to the respective pixels. Specifically, one group of the extruding ports is provided in a moving direction of the image receiving medium for one pixel so that multiple types of coating liquid having different colors or properties can be supplied from the respective extruding ports of the group. Also, the extruding ports provided for the multiple pixels may be divided into groups in a direction of the width of the image receiving medium in such a manner that extrusion of the recording liquid from a part of the groups is stopped in accordance with the width of the image receiving medium or the width of an image. In such a case, the wasteful consumption of the coating liquid can be prevented and, when the unnecessary coating liquid having no contribution to the coating process is removed and collected, an amount of liquid to be collected can be reduced.

The recording liquid, i.e., combined coating liquids can be transferred from the recording head to the image receiving medium by various kinds of modes. For example, it is possible to adopt a slot coating method by which the coating liquid extruding ports is formed on the top surface, the bottom surface or the side surface of the recording head and the image receiving medium is moved along the surface having the extruding ports with maintaining a predetermined gap from the surface. The coating liquids are extruded and guided to the gap between the surface of the recording head and the image receiving medium to form an image.

Additionally, it is possible to use a slide coating method by which a sloped surface which inclines toward the image receiving medium is formed on the top surface of the recording head and the coating liquids extruded on the sloped surface flow down to form a bead at the lower end of the sloped surface where the coating liquids meet the image receiving medium which is moving thereby, so that an image is formed or recorded on the image receiving medium. Moreover, a curtain coating method may be adopted, in which the coating liquids supplied from the recording head flow down along a guide plate onto the image receiving medium.

Although the image receiving medium itself may be a final image receiving medium such as print paper, it may be an intermediate image receiving medium. In this case, the intermediate image receiving medium is provided between the recording head and the final image receiving medium and transfer the coating liquids fed from the recording head to the final image receiving medium, and it may have a drum-like shape or an endless belt-like shape.

The controller determines a proportion of a mixture or a quantitative ratio of the coating liquids led to each extruding port based on an image signal and controls a color or a density of the mixed or combined liquid. A plurality of types of coating liquid are mixed or combined to form the mixed liquid (the recording liquid), which is extruded as a continuous flow from the extruding port and transferred to the image receiving medium. As a result, an image is formed on the image receiving medium. Since this recording liquid is applied as a continuous flow, the recording or coating liquid is not wasted and a high-quality image can be formed at high speed.

In the present invention, the image formed on the image receiving medium includes graphical intelligence patterns such as alphanumeric characters, graphical display, line art, and other image information.

DETAILED DESCRIPTION OF THE PREFERRED EMBODIMENTS

First Embodiment

An embodiment adopted to a slot coating system is described hereinafter with reference to FIGS. 1 to 5.

Figure 1:
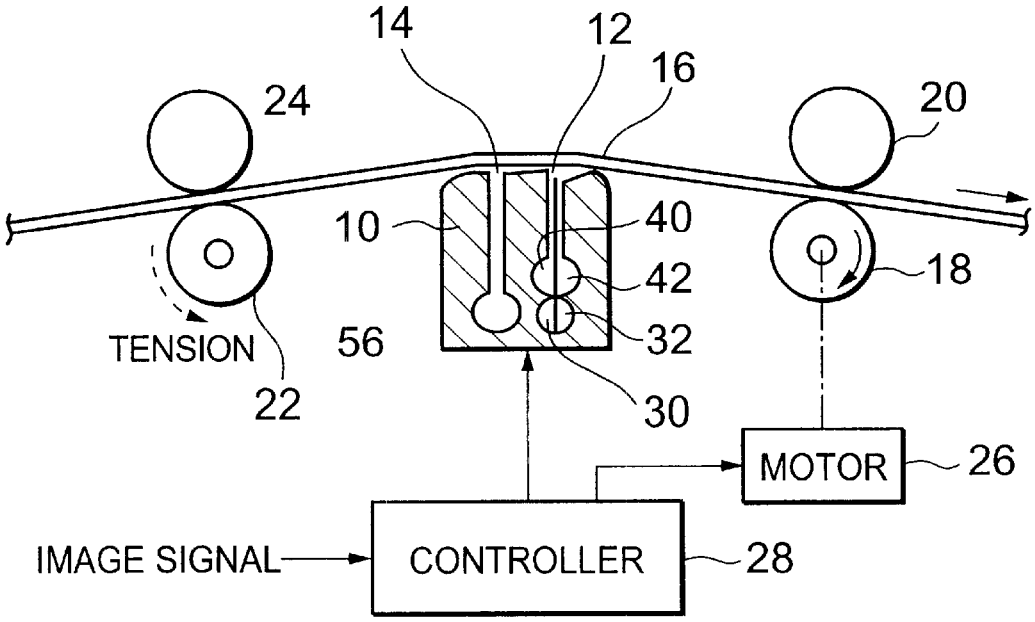
FIG. 1 is a schematic diagram showing an image forming apparatus (coating apparatus) according to a first embodiment of the present invention adopting a slot coating method.

In FIG. 1, reference numeral 10 designates a recording head, and this recording head 10 has multiple extruding ports 12 for extruding plural coating liquids and one slot-shaped opening 14 formed on the upper surface thereof. An image receiving medium 16 constituted by a recording sheet runs to one direction (the right-hand side) on the upper surface of the recording head 10 while the sheet 16 is pushed up by the recording head 10 with a fixed pressure. Reference numeral 18 denotes a driving roller for sandwiching the recording sheet 16 with a driven roller 20 so that the recording sheet 16 is fed to one direction (the right-hand side). Reference numeral 22 is a tension roller which is positioned on the side opposed to the driving roller 18 and the driven roller 20 with the recording head 10 therebetween. The tension roller 22 imparts a fixed tensile force (tension) to the recording sheet 16, which is positioned between the tension roller 22 and a driven roller 24.

Reference numeral 26 represents a driving motor for the driving roller 18, and 28 is a controller. The extruding ports 12 of the recording head 10 are independently provided in accordance with respective pixels in the width direction of the recording sheet 16 (a direction substantially orthogonal to the recording sheet running direction). Each extruding port extrudes the recording liquid constituted by coating liquids, i.e., an image forming liquid and a clear liquid. The mixing ratio of the liquids is controlled based on an image signal. For example, the image forming liquid is black ink and the clear liquid is clear or transparent ink. The density of an image to be recorded can be changed in the multistage (e.g., 256 tones) by varying a proportion or mixing ratio of the both types of liquid. The mixing ratio can be controlled by the controller 28 in the following manner.

Figure 2:
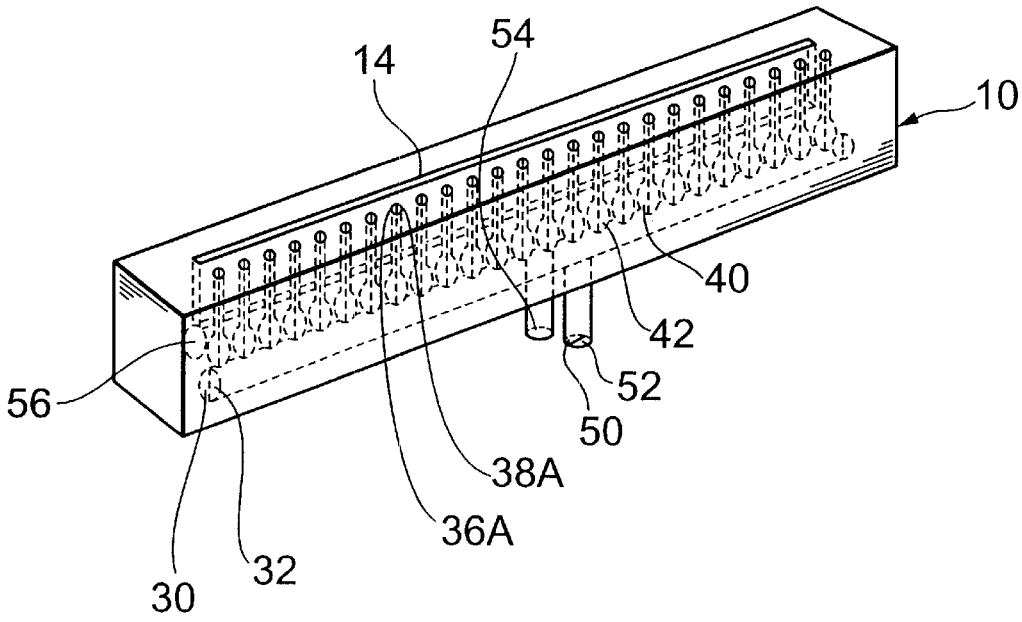
FIG. 2 is a perspective view showing the inner structure of a recording head used in a coating apparatus in FIG. 1.
Figure 3:
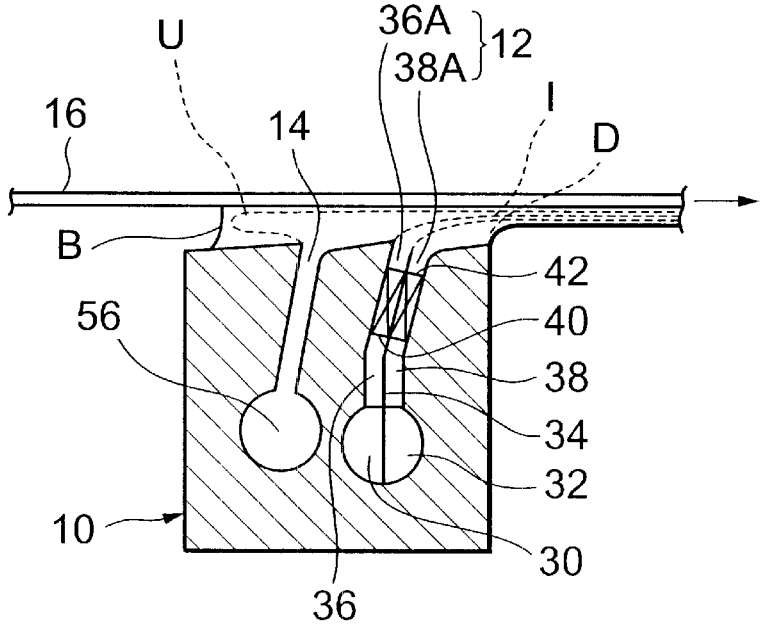
FIG. 3 is an enlarged cross-sectional view showing the recording head in FIG. 2.

In the recording head 10, one feed path 30 for supplying image forming liquid and the other feed path 32 for supplying clear liquid are formed in the width direction of the head as shown in FIG. 3. The inside of each extruding port 12 is divided by a partition 34 into two passages 36, 38 as seen in FIG. 3, and these passages 36, 38 communicates with the feed path 30 for supplying the image forming liquid and the feed path 32 for supplying the clear liquid, respectively. The other ends of the respective passages 36, 38 is outlets 36A, 38A which extrudes the image forming liquid and a clear liquid, respectively (FIG. 2). These outlets 36A, 38A are formed in the extruding port 12, so that the coating liquids extruded from the outlets 36A, 38A are combined in the port 12 and extruded from the port 12 as a laminar flow of the combined recording liquid. Further, an image forming liquid extrusion amount control valve 40 and a clear liquid extrusion amount control valve 42 are provided to these passages 36, 38 as coating liquid extrusion amount controlling means.

Figure 4:
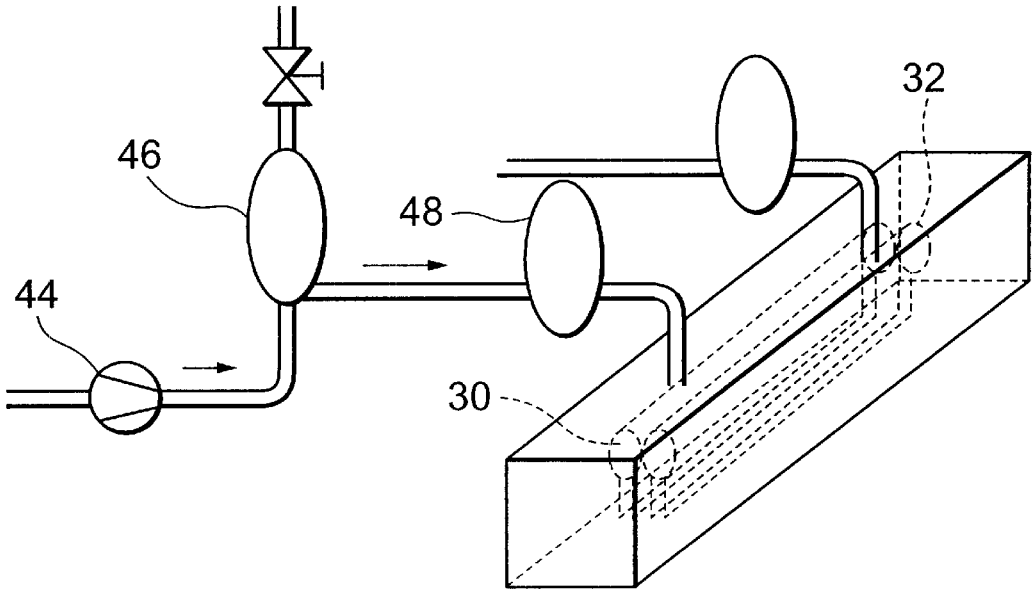
FIG. 4 is a diagram showing a feed path for supplying a coating liquid such as an image forming liquid or a clear liquid.

As shown in FIG. 4, the image forming liquid (ink) is supplied with a fixed pressure from a pump 44 to the feed path 30. In FIG. 4, numeral 46 is a dumper which absorbs pulses of the extrusion pressure of the pump 44 to maintain the extrusion pressure constant. 48 is a filter which removes residue deposits formed or contaminating in the liquid. Similarly, the clear liquid is fed to the feeding path 32 with a constant pressure by the action of not-shown pump, and the structure of the pump and other parts is the same with that of the feeding path 30 for supplying the image forming liquid.

The image forming liquid and the clear liquid are supplied through an image forming liquid supply port 50 and a clear liquid supply port 52 to the feeding paths 30 and 32, respectively.

Similarly, as seen in FIG. 2, the undercoating liquid is supplied from an undercoating liquid supply port 54 to a feed path 56 by a not-shown pump. The feed path 56 for supplying the undercoating liquid is elongated in the width direction of the recording head 10, and the slot-shaped opening 14 communicates with this feed path 56. The slot-shaped opening 14 is positioned on the upstream side of the aligned extruding ports 12 with respect to the running direction of the recording sheet 16 as shown in FIGS. 1 and 3. With such construction, on the surface of the recording sheet 16 is uniformly applied the undercoating liquid and thereafter applied the mixed liquid, i.e., the composite recording liquid extruded from the extruding port 12.

The extrusion amount control valves 40, 42 may have the same structure. For example, a diaphragm valve driven by a piezoelectric device is suitable. It is to be noted that these control valves 40, 42 or the passages 36, 38 for accommodating these control valves 40, 42 may be produced by a micro-machine manufacturing method to which a technique used in a manufacturing process for a semiconductor device and the like is applied. Although the respective extruding ports 12 are drawn at large intervals in FIG. 2, they are actually provided at extremely-small intervals of pixels.

Figure 5A:
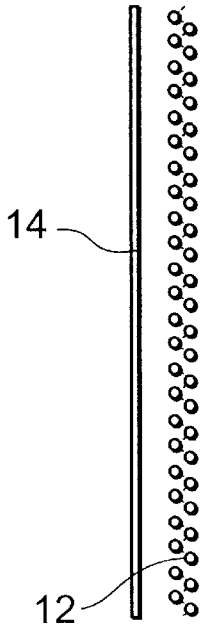
FIGS. 5A and 5B are explanatory views showing examples of arrangement of coating liquid extruding ports provided in the recording head.
Figure 5B:
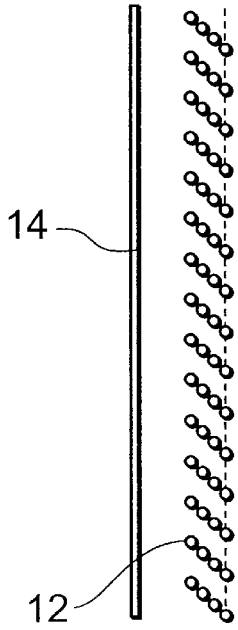

Incidentally, in order to narrow in interval of the coating positions by each extruding ports 12, the adjacent extruding ports 12 may be biased or displaced in the feeding direction of the recording sheet 16 as shown in FIG. 5. FIG. 5A shows that the adjacent extruding ports are alternately biased in the opposed directions and FIG. 5B shows that an appropriate number (e.g., four) of the extruding ports 12 are arranged so as to be sequentially biased in one direction. In FIGS. 5A and 5B, the image receiving medium or recording sheet 16 is fed to the right-hand direction. When biasing each extruding port 12 in this manner, it is needless to say that the controller 28 must change the timing for operating the control valves 40, 42 for different pixels in accordance with a quantity of bias.

According to this embodiment, the controller 28 determines the timing for opening/closing and the ratio of opening/closing time of the control valves 40, 42 so that the relative proportion of the image forming (black) liquid and clear liquid corresponds to the density of each pixel based on an image signal. The determined timing and time period for opening/closing is fed to the respective control valve 40, 42 so that the supply amount and timing of the black and clear liquids are controlled by the control valves 40, 42. As a result, the black liquid and the clear liquid having the controlled amount corresponding to each pixel density are extruded from the respective outlets 36A, 38A into the extruding port 12 to form a composite recording liquid. The recording liquid in the port 12 is extruded from the port 12. On the other hand, a predetermined amount of the undercoating liquid is constantly extruded in the zonal, planate or film-like form the slot opening 14. Therefore, when the recording sheet 16 is moved to a predetermined direction by the motor 26, the undercoating liquid is applied so as to have a uniform in thickness and subjected to surface treatment. The composite recording liquid having a density determined by mixing ratio of multiple types of the coating liquid is extruded from the extruding port 12 to be applied on the undercoating liquid. An image density on the recording sheet 16 varies with a mono-tone gradation by changing the mixing ratio of the black and clear liquids.

A gap size between the recording head 10 and the recording sheet 16 is determined in consideration to a balance of extrusion pressures from the extruding port 12 and the slot opening 14, respectively, and a tension applied to the recording sheet 16. In this gap, the image forming liquid I, the clear liquid D and the undercoating liquid U make a liquid bank, i.e., a bead B (as seen in FIG. 3). In order to form an image which is free from distortion, it is required that the image forming liquid I is orderly and smoothly transferred to the recording sheet 16 without distortion in the bead B.

According to this embodiment, as shown in FIG. 3, a stream line of the undercoating liquid U is bent from the slot opening 14 toward the upstream direction (the left-hand direction) in the bead B and further bent toward the downstream direction (the right-hand direction). Since the undercoating liquid U is transparent, occurrence of turbulence in the stream line of the undercoating liquid in the bead B does not result in any disadvantages. The image forming liquid I and the clear liquid D are so supplied as to be superimposed on the undercoating liquid U which has made a U-turn on the upstream side in the bead B to become a straightened flow. The image forming liquid I and the clear liquid D flow without any turbulence, thereby forming an excellent image.

Further, in this embodiment, the extruding port 12 and the slot opening 14 have the front edge shape formed on the wall surface on the downstream side which is bent along the stream line toward the downstream side (the right-hand side) and have the front edge shape formed on the wall surface on the upstream side which is tapered toward the downstream side. Therefore, any sinuosity or turbulence in the stream line of the coating liquid cannot be observed in particular, and the coating liquid can smoothly flow on the undercoating liquid. In addition, since the clear liquid extruding outlet 38A (FIG. 3) is positioned to be closer to the downstream side than the image forming liquid extruding outlet 36A, the clear liquid D can intervene between the image forming liquid I and the upper surface of the recording head 10. Accordingly, even if the clear liquid D comes into contact with the upper surface of the recording head 10 to generate a delay, the delay of the image forming liquid I is small, further improving the image quality.

In this embodiment, since one type of the image forming liquid and one type of the clear liquid are supplied to each extruding port 12, it is possible to form an image whose density can vary with a single color. However, by using and combining plural image forming liquids having a plurality of colors (e.g., yellow, magenta, cyan, and black) to extrude from a common extruding port, a colored image can be formed or recorded.

Preferably, a decoloration preventing agent is contained in the undercoating liquid, the clear liquid or the image forming liquid in order to avoid deterioration of the recording liquid due to ultraviolet rays or oxidation. As a decoloration preventing agent, there can be used, for example, an antioxidant, an UV absorber or a given kind of metallic complex (e.g., Ni complex). Examples of antioxidants, include chroman-based compounds, coumarane-based compounds, phenol-based compounds (e.g., hindered-phenols and the like), hydroquinone derivatives, hindered-amine derivatives, spiroindan-based compounds and others. Moreover, a compound disclosed in Unexamined Japanese Patent Publication (KOKAI) No. 159644/1986 is also effective.

As an UV absorber, there can be used benzotriazol-based compounds (U.S. Pat. No. 3,533,794), 4-thiazolidone-based compounds (U.S. Pat. No. 3,352,681), benzophenone-based compounds (Unexamined Japanese Patent Publication (KOKAI) No. 2784/1981) and other compounds disclosed in Unexamined Japanese Patent Publication (KOKAI) Nos. 48535/1979, 136641/1987, 88256/1986 and others. Further, the UV absorbing polymer disclosed in Unexamined Japanese Patent Publication (KOKAI) No. 260152/1987 is also effective. As a metallic complex, it is possible to employ compounds disclosed in U.S. Pat. Nos. 4,241,155 and 4,245,018, Unexamined Japanese Patent Publication (KOKAI) Nos. 174741/1987 and 88256/1986, Japanese Patent Application Nos. 234103/1987, 31096/1987 and 230596/1987.

An example of the useful decoloration preventing agent is disclosed in Unexamined Japanese Patent Publication (KOKAI) No. 215272/1987. To avoid color deterioration of the pigment transferred to the image receiving material, the decoloration preventing agent may be included in the image receiving medium in advance or it may be supplied from the outside by a method for transferring from a pigment extending material and the like. The antioxidant, the UV absorber and the metallic complex described above may be combined to be used. Additionally, the antioxidant, the UV absorber and the metallic complex described above may be used as an emulsified substance.

Second Embodiment

Figure 6:
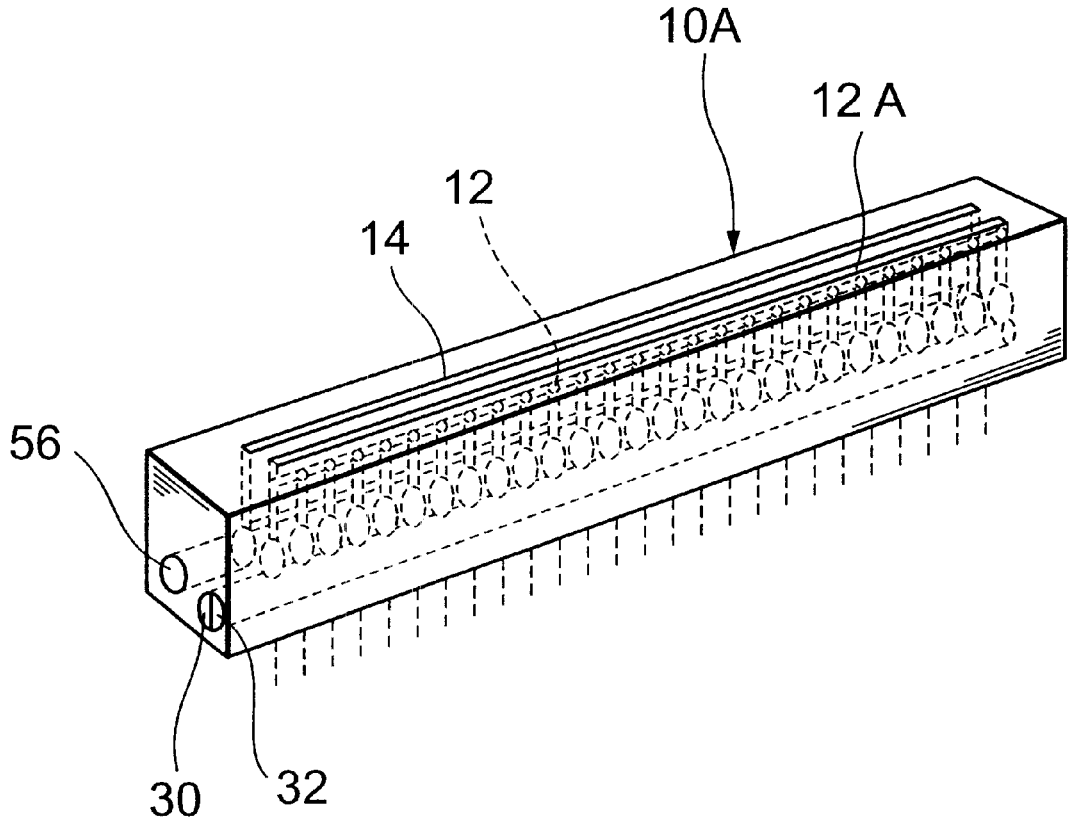
FIG. 6 is a perspective view of a recording head according to a second embodiment of the present invention.

FIG. 6 is a perspective view of a recording head used in an image forming apparatus with coating liquids according to the second embodiment of the invention. The recording head 10A has a slot-shaped opening 12A which is elongated in the width direction of the head 10A and positioned at the downstream side of the extruding ports 12. Specifically, the aligned the extruding ports 12, which has the same construction as those shown in FIG. 2, are opened to the slot-opening 12A.

According to this embodiment, since the recording liquid constituted by plural coating liquids extruded from the respective ports 12 corresponding to each pixel are continuously gathered and integrated in the slot-shaped opening 12A in the width direction, the laminar flow of coating liquids is applied in the wide zonal or sheet-like form. Coating can be therefore stably performed. Further, superimposition on the undercoating liquid can be stably carried out, which is suitable for improvement in the image quality.

Third Embodiment

Figure 7:
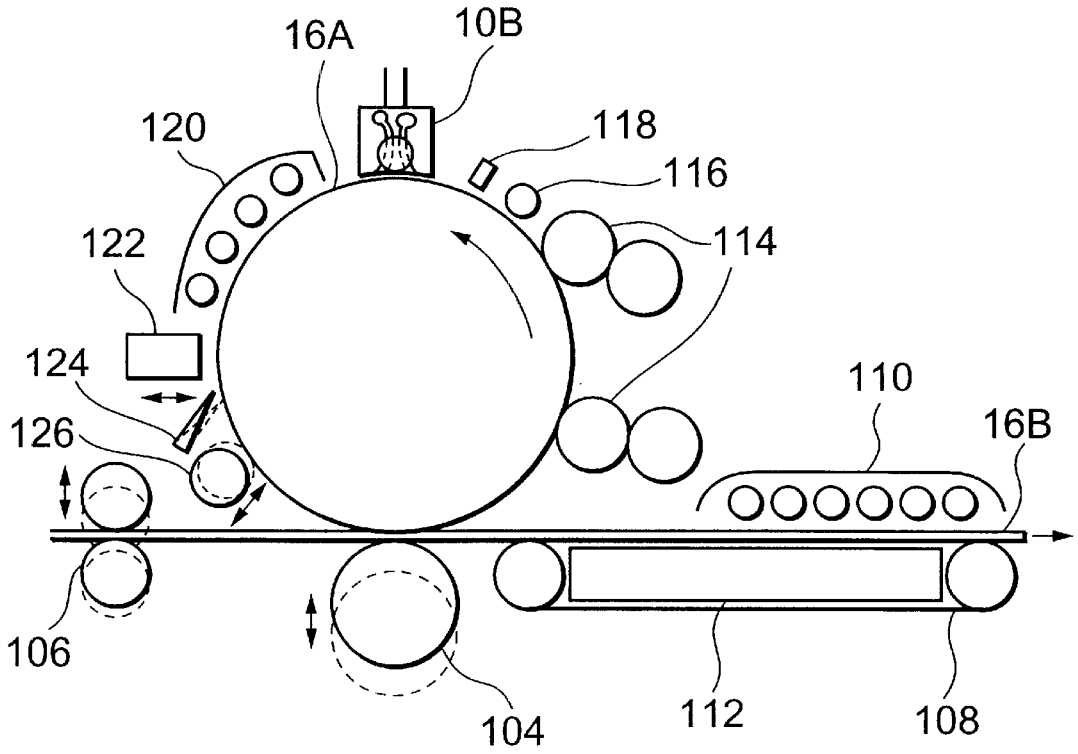
FIG. 7 is an illustrated diagram showing the concept of an image forming apparatus (coating apparatus) according to a third embodiment of the present invention.
Figure 8:
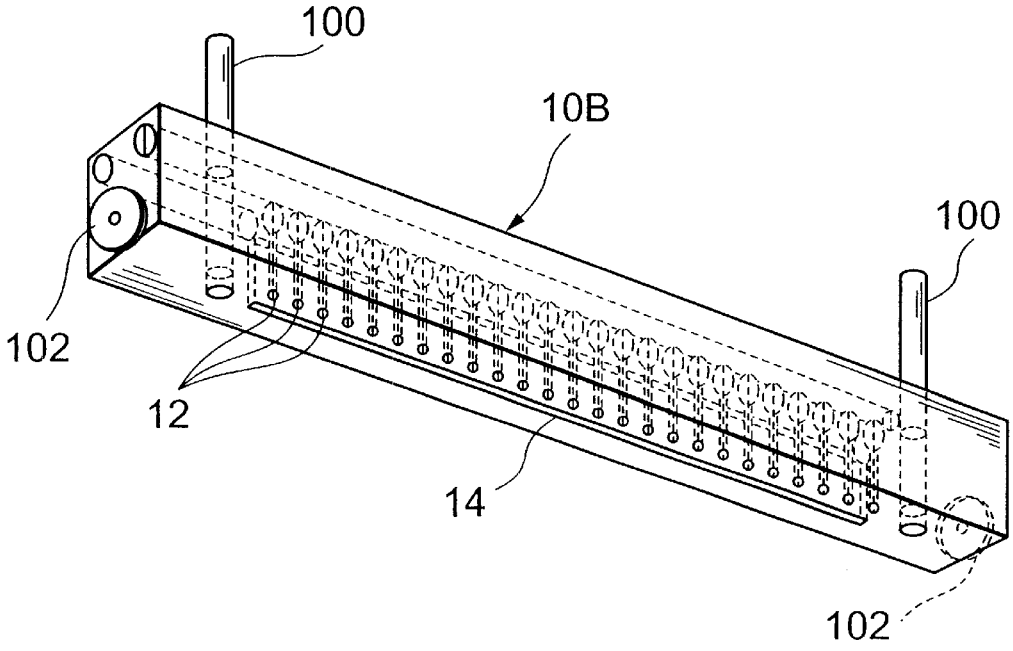
FIG. 8 is a perspective view showing a recording head used in the coating apparatus in FIG. 7.

FIG. 7 is an illustrated diagram showing the concept of an image forming apparatus (coating apparatus) according to a third embodiment of the present invention; FIG. 8, a perspective view showing the inside of a recording head used in this embodiment; and FIG. 9, an explanatory illustration showing the relationship between adhesion and cohesion of each type of applied liquid. This embodiment employes a slot coating method as similar to the foregoing first and second embodiments illustrated in FIGS. 1 to 6, but it is different in that the recording head 10B forms an image on the final image receiving medium 16B through the intermediate image receiving medium 16A.

The intermediate image receiving medium 16A is a cylindrical drum and the recording head 10B supplies the coating liquid I and the undercoating liquid U to the upper periphery of this drum 16A. The coating liquid I is a laminar flow or mixture of the image forming liquid and the clear liquid as described above. Since the recording head 10B is constituted as similar to those explained in connection with FIGS. 1 to 5, like reference numerals denote like or corresponding part to omit the tautological description. The recording head 10B is suspended by a pair of guide posts 100 so as to be capable of moving in the vertical direction, and auxiliary rollers 102 provided on the both right and left sides of the recording head 10B. The rollers contact with the both ends of the upper periphery of the drum 16A, thereby maintaining the distance between the recording head 10B and the drum 16A constant.

The recording liquid (layered coating liquids) and the undercoating liquid extruded from the recording head 10B are loaded onto the drum 16A and carried downwards by the counterclockwise rotation of the drum 16A. The final image receiving medium 16B such as recording paper is pushed by a pressure roller 104 against the lower periphery of the drum 16A to travels at the same speed. As a result, the recording liquid and the undercoating liquid on the drum 16A are transferred to the recording paper 16B. The recording paper 16B is fed by a guide roller 106 and a guide belt 108 toward the right-hand side in FIG. 7 at a constant speed, and the recording liquid and the undercoating liquid are dried by a heater 110 in the intermediate position of the feeding path. 112 is a suction box which sucks the recording sheet 16B on the upper surface of the guide belt 108 so that the sheet 16B is carried in close contact with the guide belt 108.

Additionally, two cleaning rollers 114, 114 contact with and roll on the drum 16A to clean the surface of the drum 16A. 116 and 118 are a heater and an charged electrode which heat and charge the surface of the drum 16A to carry out the surface treatment for smoothing adhesion of the coating liquid and the undercoating liquid to the rotary drum 16A. 120 and 122 are a heater and an dry air blowing duct for preliminarily drying the coating liquids and the undercoating liquid supplied from the recording head 10B.

Reference numeral 124 denotes a blade for collecting liquid which can serve as coating liquid collecting means. This blade 124 strips off and collects the liquid which is unnecessary for the image formation from the transfer drum 16A. Incidentally, since the state of application of the coating liquid and the undercoating liquid can be stabilized by constantly extruding them from the recording head 10B, the image formation can be stabilized by constantly supplying the liquid while removing the unnecessary liquid by using this blade 124. 126 is a cleaning roller for further cleaning the surface of the drum 16A from which the unnecessary liquid has been removed by the blade 124.

As shown in FIG. 8, the undercoating liquid extruding slot 14 is provided at the upstream side of the coating liquid extruding ports 12. That is, the surface or the drum 16A travels from the left-hand side to the right-hand side in FIG. 8. Accordingly, the recording liquid of the coating liquids is superimposed on the undercoating liquid which has been transferred onto the drum 16A. When the superimposed layers of the undercoating liquid and the recording liquid is transferred to the recording paper 16B, the undercoating liquid will be the uppermost layer on the recording liquid.

Figure 9:
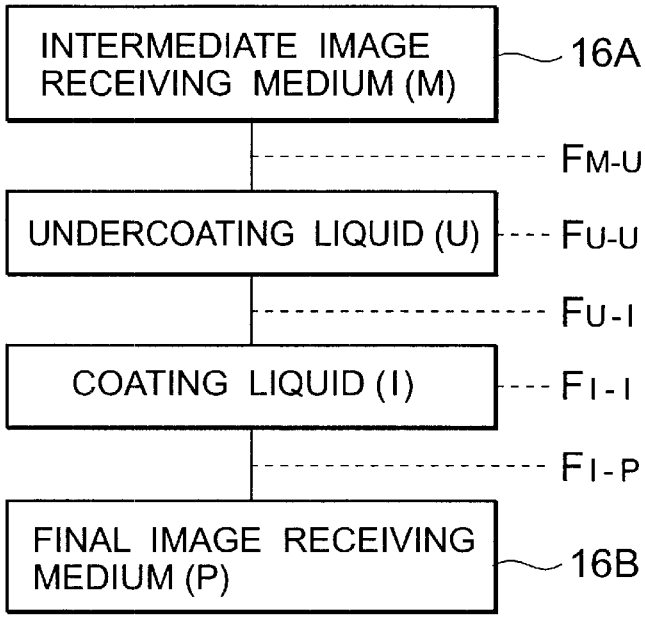
FIG. 9 is an explanatory illustration showing the relationship between adhesion and cohesion of each type of applied liquid.

The following conditions are required for the smooth transfer of the undercoating liquid and the recording liquid applied to the drum 16A onto the recording paper 16B. FIG. 9 is an explanatory illustration showing each layer and the relationship between the adhesion of the liquid and the cohesion in the liquid in such a case. In the figure, it is assumed that the intermediate image receiving medium or drum 16A is represented as M; the undercoating liquid, U; the coating liquid (the recording liquid), I; the final image receiving medium 16B, P; the adhesion acting between these members, $F_{M-U}$, $F_{U-I}$ and $F_{I-P}$; and the cohesion in the undercoating liquid and the coating liquid, $F_{U-U}$ and $F_{I-I}$. Here, each type of liquid and the state of the surface of the receiving mediums 16A and 16B are set in such a manner that $F_{M-U}$ becomes minimum.

Here, the coating liquid (the recording liquid) may be obtained by homogeneously mixing the image forming liquid and the clear liquid. For example, the mixture can be obtained by providing a static mixer having a honey-comb shape or a pipe-like spiral shape for agitating the liquid in the extruding ports 12. Further, if the liquid which is in close contact with the intermediate image receiving medium (drum) 16A is transparent liquid like the clear liquid, the cohesion of the coherent liquid may be minimized.

Fourth Embodiment

Figure 10:
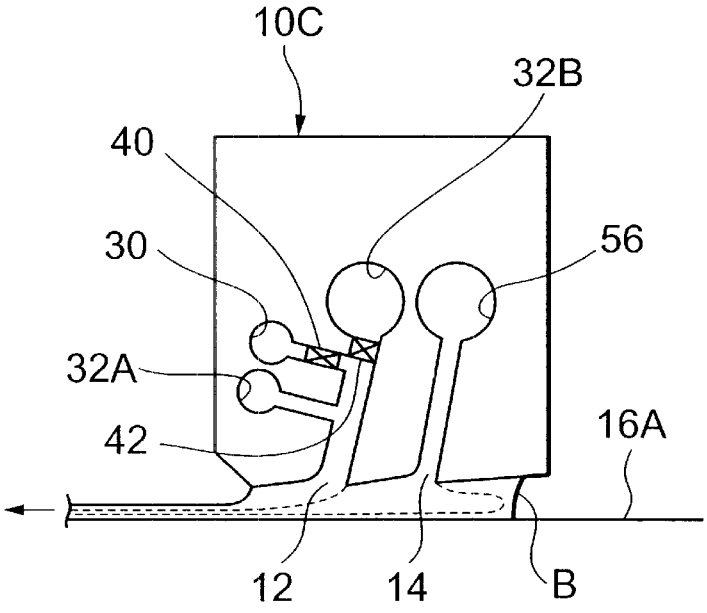
FIG. 10 is a cross-sectional view showing a recording head used in a coating apparatus according to a fourth embodiment of the present invention.

FIG. 10 is a cross-sectional view showing a recording head used in a coating apparatus according to a fourth embodiment of the present invention. The recording head 10C is used in the slot coating method similar to that illustrated in FIG. 7, and an amount of the image forming liquid supplied from the feed path 30 is controlled by a control valve 40. Further, the clear liquid is divided into two layers and supplied so as to sandwich the image forming liquid from the both sides. More specifically, one feed path 32A constantly extrudes a fixed amount of the clear liquid and an amount of the clear liquid extruded from the other feed path 32B is varied by the control valve 42. At this time, the two clear liquids and the image forming liquid are controlled in such a manner that their total volume flow rate becomes substantially constant. Therefore, the overall amount of the coating liquid extruded from the port 12 becomes a fixed value, thereby enabling the stable coating.

Here, since it can be considered that the clear liquid supplied from the feed paths 32A and 32B and the image forming liquid supplied from the feed path 30 have a substantially-fixed fluid pressure, the total flow rate of these types of liquid is nearly determined by a cross sectional area of a flow path of the feed path for supplying clear liquid 32A on the downstream side. Therefore, a flow rate of the clear liquid extruded from the feed path 32A increases or decreases in accordance with rise and fall of a total flow rate of other types of coating liquid, i.e., a total flow rate of the clear liquid supplied from the feed path 32B and the image forming liquid supplied from the feed path 30. Therefore, the extrusion amount control valve is not necessary in the flow passage of one feed path for supplying clear liquid 32A, thereby simplifying the structure of the recording head 10C.

Further, the undercoating liquid extruding slot 14 is formed at the position in the upstream side of the coating liquid extruding port 12. Thus, the stream line of the undercoating liquid which is constantly supplied by a predetermined amount from the feed path 56 may be bent toward the upstream side in the bead B according to circumstances, but the coating liquid (recording liquid) having the three-layer structure in which the image forming liquid is sandwiched by the two clear liquid layers from the both sides is superimposed on the stable undercoating liquid and then supplied. Therefore, the distortion is not generated in an image. Additionally, since the image forming liquid is sandwiched by the two clear liquid layers from the both side, the clear liquid directly comes into contact with the inner wall surface of the extruding port 12, and the flow of the image forming liquid is smoothed to further improve the image quality.

Fifth Embodiment

Figure 11:
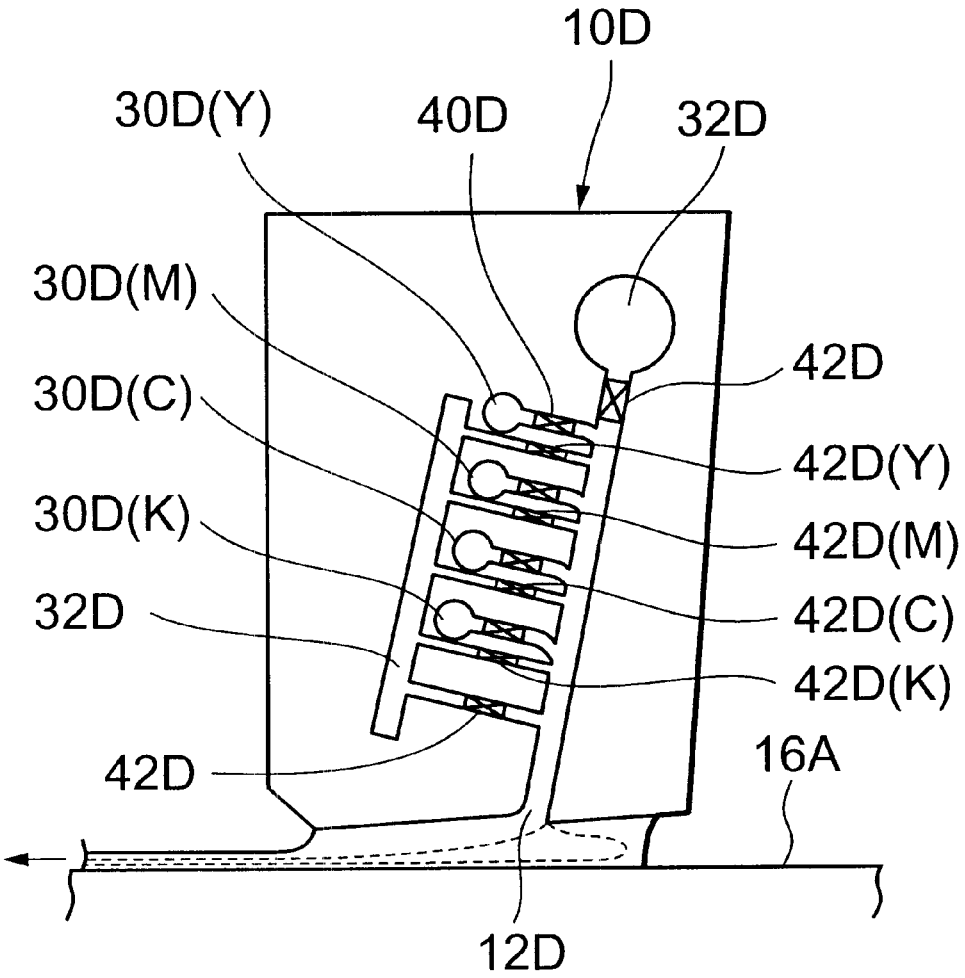
FIG. 11 is a cross-sectional view showing a recording head used in a fifth embodiment.
Figure 12:
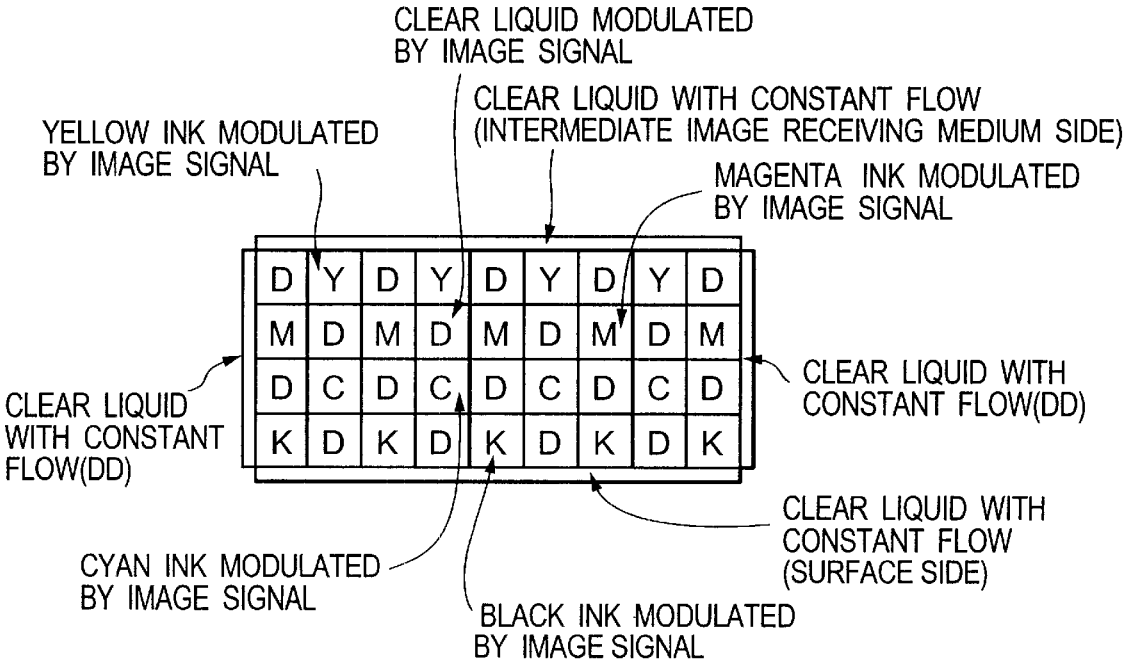
FIG. 12 is a cross-sectional view typically showing the superimposed structure of the combined coating liquids applied onto an intermediate image receiving medium by the recording head in FIG. 11.

FIG. 11 is a cross-sectional view of a recording head 10D used in to a fifth embodiment; and FIG. 12 is a cross-sectional view for typically showing the superimposed layer structure of the coating liquid (recording liquid) applied by the recording head 10D. This recording head 10D is used for forming a color image by the above-mentioned slot coating method.

The recording head 10D includes feeding paths 30D(Y), 30D(M), 30D(C) and 30D(K) for supplying image forming liquid having four colors, i.e., yellow (Y), magenta (M), cyan (C) and black (K); four control valves 40D provided in respective passages communicating with the extruding ports 12D, for controlling each amount of extrusion of the image forming liquid; two feed paths 32(D) for supplying the clear liquid (D) between the image forming liquids having the respective colors and to the both surfaces of the liquid layer; control valves 42D(Y), 42D(M), 42D(C) and 42D(K) for controlling an amount of the clear liquid to be supplied in the vicinity of the respective types of image forming liquid; and two control valves 42D for controlling an amount of clear liquid supplied to the both surfaces of the superimposed layer. Here, when an amount of supply of the image forming liquid is changed, the amount of supply of the clear liquid (D) flowing between the respective types of the image forming liquid having the different colors is also changed in reverse proportion to the change of supply amount of the image forming liquid, whereby the clear liquid has a function for maintaining the thickness of the superimposed layer substantially constant. Moreover, it is determined that the clear liquid that covers the both sides of the superimposed layer has a fixed amount of flow irrespective of the image signal.

The cross-sectional structure of this superimposed layer is as shown in FIG. 12. In this figure, reference characters Y, M, C and K represent the image forming or recording liquid (ink) having respective colors and their amounts of supply are modulated based on the image signal. As shown in FIG. 11, when the image forming liquids having respective colors (Y, M, C and K) are superimposed in the order of Y, M, C and K from the side closer to the intermediate image receiving medium 16A, the upper surface of the superimposed layer in FIG. 12 is positioned to oppose the intermediate image receiving medium 16A. Although the two types of image forming liquid that have two colors are superimposed in the thickness direction of the coating membrane in the superimposed layer, it is needless to say that the clear liquid (D) may be supplied in place of all the types of the image forming liquid to provide transparency (non-color) or two or more colors (three or four colors) may be mixed.

The top surface (the free surface side) and the bottom surface (the intermediate image receiving medium side) of the superimposed layer are covered with the clear liquid (D) respectively, and the control valve 42D may be controlled by the image signal so as to adjust the amounts of the clear liquid. In this case, the clear liquid supplied to the vicinity of each opening of the feed paths for supplying image forming liquid functions to prevent the respective types of the image forming liquid from adhering to the inner wall of the recording heads. Another type of clear liquid (DD) having constant flow rate may be applied to the superimposed layer on the both end surfaces thereof in the width direction. In this case, another feed path for supplying the clear liquid (DD) may be added to the recording head 10D.

In this embodiment, since the image forming liquid having the respective colors (Y, M, C and K) and the clear liquid constitute a laminar flow and are orderly applied in the form of a layer and they are not mixed with each other in the superimposed layer, a streaky irregularity which corresponds to each color in each pixel can be recognized in an image which is formed and dried in the final image receiving medium 16B. In order to remove such an irregularity, the image forming liquid is mixed with the clear liquid immediately before the extruding ports 12 for respective pixels. Thus, it is preferable to provide, e.g., a so-called static mixer having a thin honey-comb shape or a pipe-like spiral shape in the middle of the passage for the mixed liquid.

Sixth Embodiment

Figure 13:
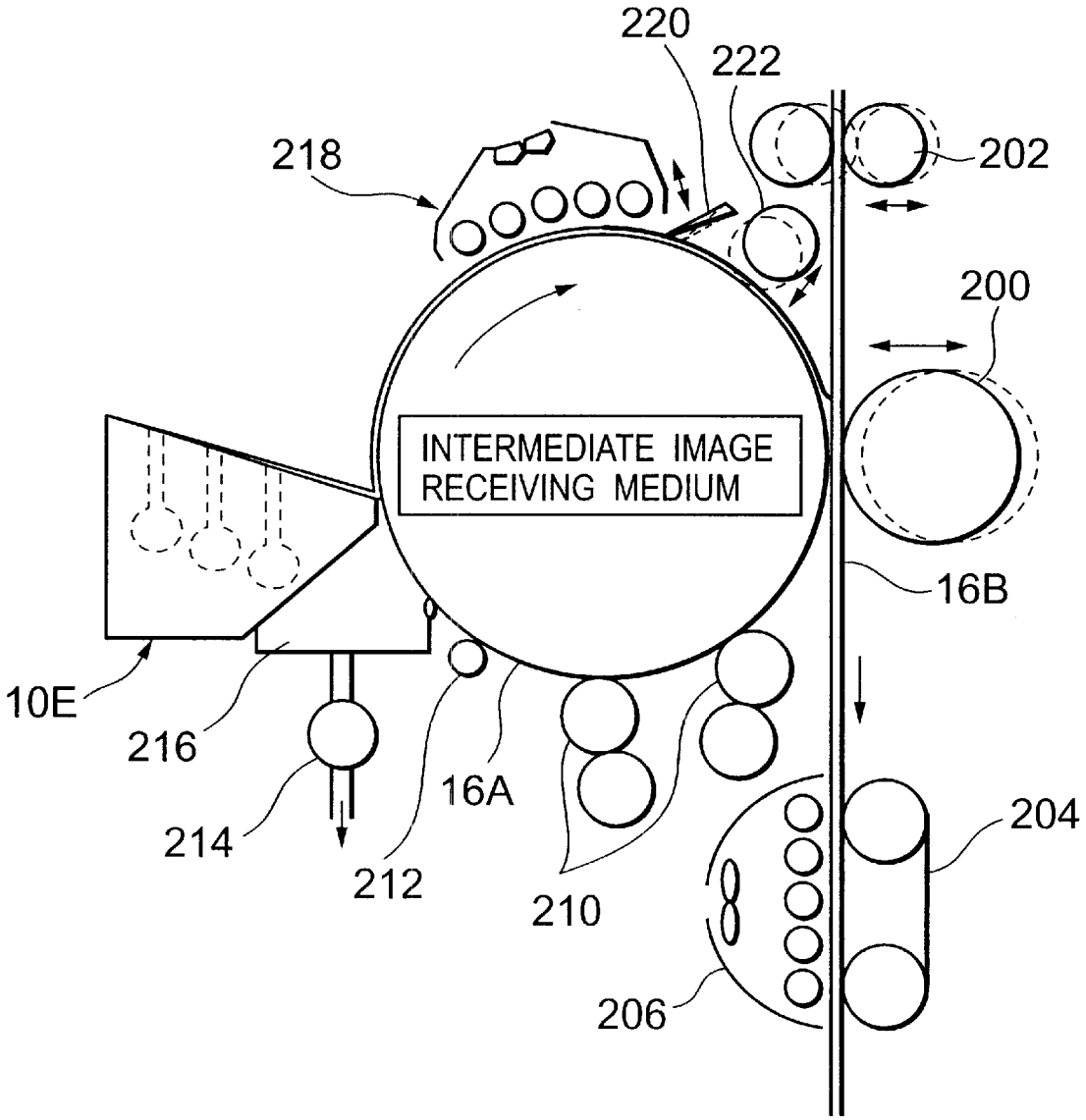
FIG. 13 is an illustrated diagram showing a coating apparatus adopting a slide coating method according to a sixth embodiment of the present invention.
Figure 14:
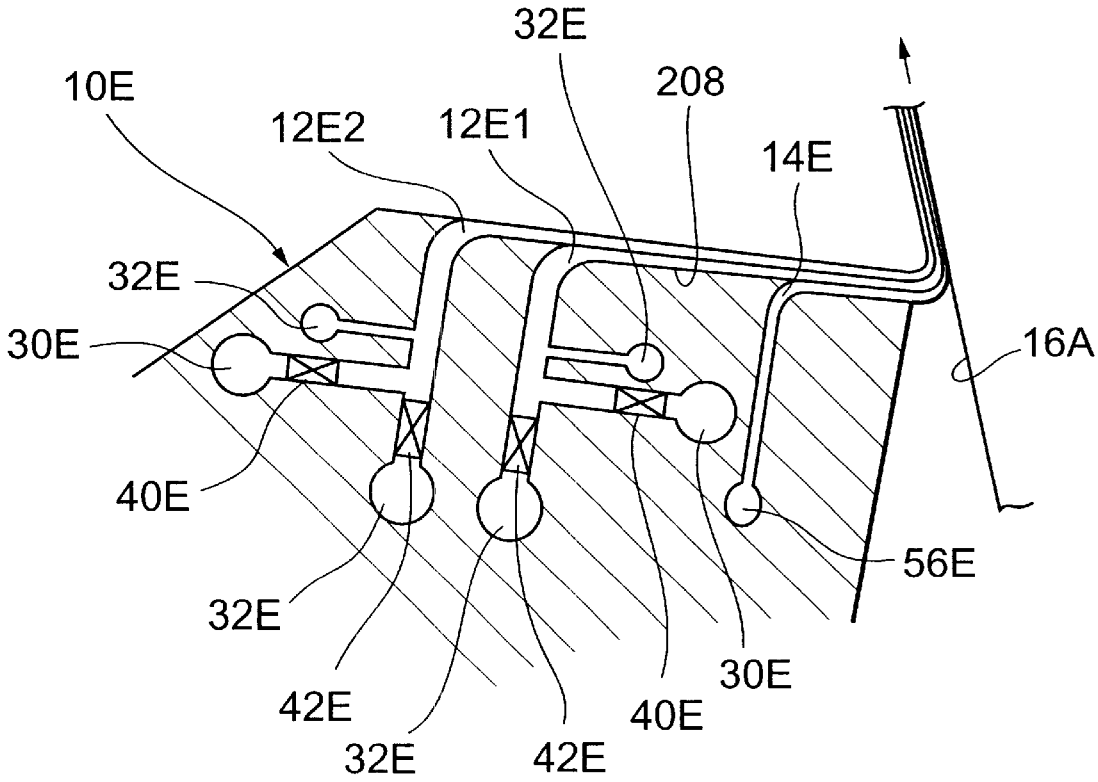
FIG. 14 is a cross-sectional view showing the recording head used in the coating apparatus in FIG. 13.
Figure 15:
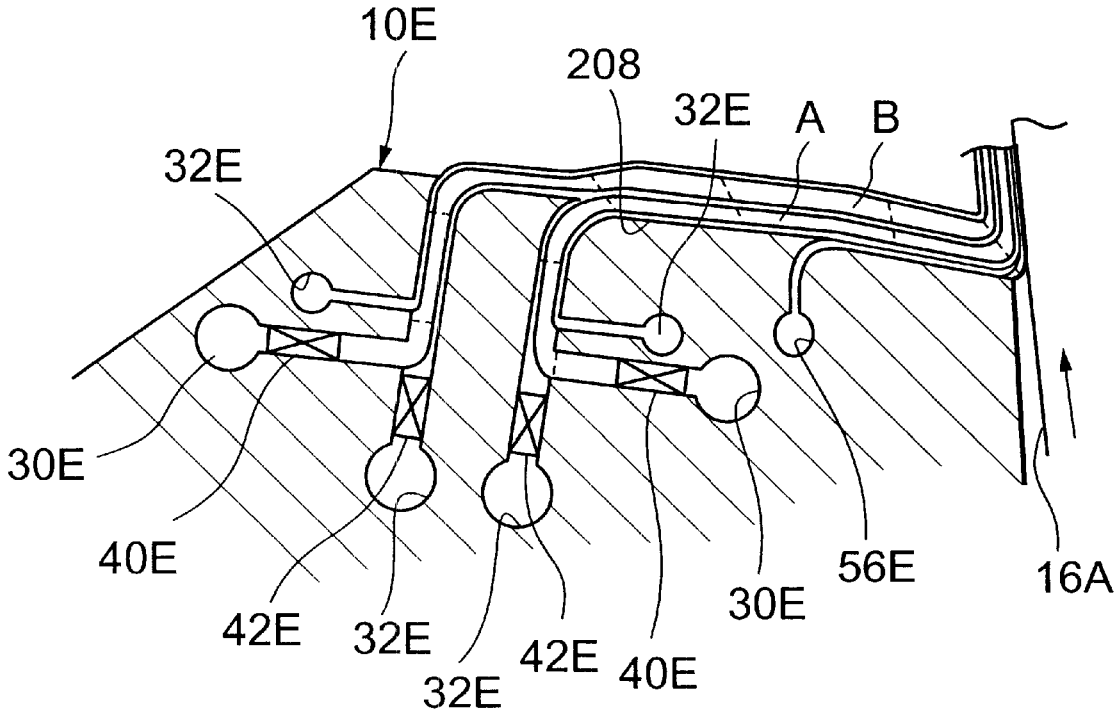
FIG. 15 is a view showing the layer structure of the combined and laminar coating liquids which flows on a sloped top surface of the recording head in FIG. 14.

FIG. 13 is a view schematically showing a coating apparatus according to a sixth embodiment; FIG. 14 is a cross-sectional view showing a recording head used in the coating apparatus; and FIG. 15 is a view showing a layer structure of the coating liquid (the recording liquid). This embodiment shows a coating apparatus adopting a slide coating mode.

Reference numeral 10E denotes a recording head which is provided on one side (the left-hand side) of the intermediate image receiving medium, i.e., a rotary transfer drum 16A. The recording head 10A supplys the coating liquid (the recording liquid) to the drum 16A from this position. On the other side (the right-hand side) of the drum 16A, the final image receiving medium, i.e., recording sheet 16B is pressed by a pressure roller 200, and the coating liquid (the recording liquid) is transferred to the recording paper 16B from the surface of the drum 16A at this position. Here, the recording sheet 16B is substantially-vertically fed downwards by a guide roller 202 and a guide belt 204 and dried out by a heater 206 at the intermediate position in the travelling path of the sheet 16B.

As shown in FIG. 14, the recording head 10E has an sloped surface 208 on the upper surface thereof. This sloped surface 208 inclines downwards to the intermediate image receiving medium or drum 16A and the lower edge thereof is horizontal to the width direction and neighboring to the drum 16A. On this inclined surface 208 are formed an opening 14E for extruding undercoating liquid, a first coating liquid extruding port 12E1 and a second coating liquid extruding port 12E2 from the lower edge in the mentioned order. It is to be noted that the opening 14E for extruding undercoating liquid has a slot shape which is continuous in the width direction and the first and second extruding ports 12E1, 12E2 are separately provided for each pixel.

The undercoating liquid used herein is supplied from a feed path 56E and its adhesion with respect to the drum 16A or the cohesion in the undercoating liquid is so set as to be smaller than the adhesion or cohesion of any other type of image forming liquid or clear liquid. In addition, to the extruding ports 12E1, 12E2 are extruded the coating liquid (the recording liquid) which has a three-layer structure in which two types of image forming liquid A and B whose amount of extrusion is controlled by the control valve 40E are sandwiched by the clear liquid from the both sides. Reference numeral 30E denotes each feed path for supplying image forming liquid (A, B); and 32E, a feed path for supplying clear liquid which is fed to the both sides of each type of the image forming liquid (A, B). Further, reference numeral 42E designates a control valve for controlling an amount of one of two types of the clear liquid supplied to the respective extruding ports 12E1, 12E2.

According to this embodiment, as shown in FIG. 15, the respective types of image forming liquid A and B orderly flow down on the sloped surface 208 in the form of a laminar flow in which the image forming liquid is sandwiched between the clear liquid and are transported to the intermediate image receiving medium 16A. The supply amount of the respective types of image forming liquid A and B is controlled in accordance with the image signal. Also, the operation timings of the respective control valves 40E and 42E are compensated in such a manner that these types of image forming liquid A and B are controlled to become in phase with each other on the intermediate image receiving medium 16A.

In FIG. 13, reference numeral 210 represents each cleaning roller, and 212 is a heater. These members carry out preliminary treatment of the surface of the intermediate image receiving medium or drum 16A to improve the wettability of the liquid. Reference numeral 214 designates an exhaust pump; and 216, a suction chamber. The suction chamber 216 faces to the vicinity of the coating liquid (which includes the recording liquid and the undercoating liquid) moving portion between the recording head 10E and the drum 16A from the lower side and prevents the air from entering between the undercoating liquid and the drum 16A so as to avoid the distortion of the image due to the air contamination. 218 is a heater for preliminarily drying the applied liquid. 220 is a blade as coating liquid collecting means and 222 is a cleaning roller. These members 220, 222 remove and collect the coating liquid which is unnecessary for image formation, e.g., the unnecessary coating liquid existing on the front edge side or rear edge side of the image.

Seventh Embodiment

Figure 16:
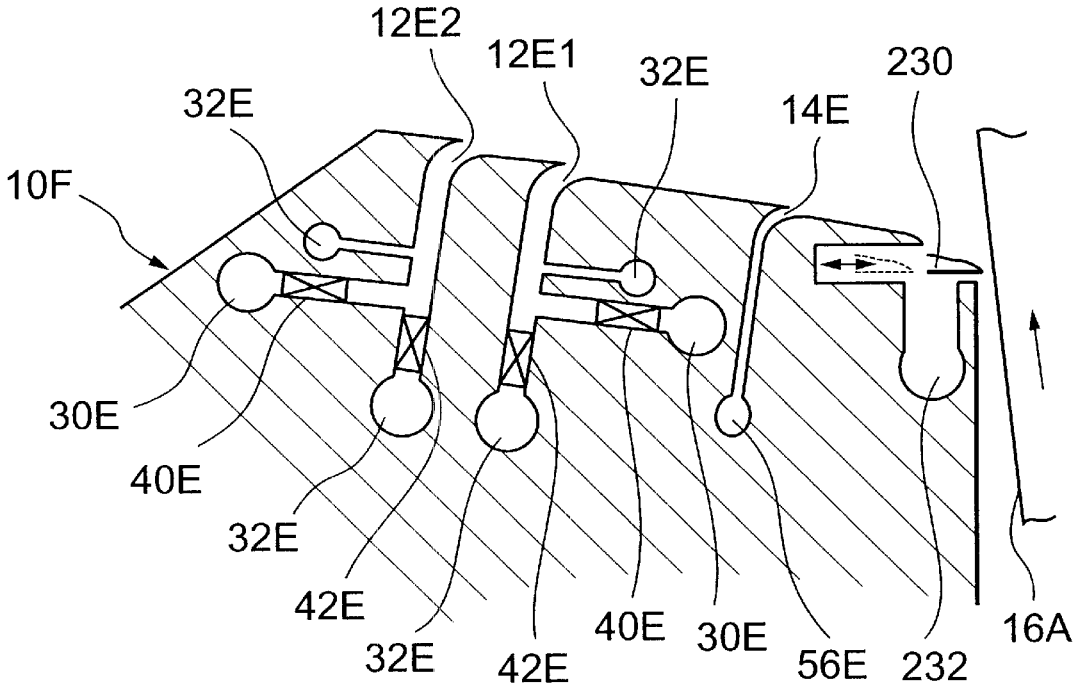
FIG. 16 is a cross-sectional view showing the recording head used in a coating apparatus according to a seventh embodiment of the present invention.

FIG. 16 is a cross-sectional view of a recording head 10F used in a coating apparatus according to a seventh embodiment. The recording head 10F is used for the slide coating mode similar to that illustrated in FIG. 13, and like reference numerals denote parts similar to those in the recording head 10E depicted in FIGS. 14, 15, thereby omitting tautological explanation. As different from the recording head 10E shown in FIGS. 14, 15, a collection switching plate 230 and a coating liquid collecting path 232 as coating liquid collecting means are added to the sloped surface 208.

During the normal operation of the image formation, the collection switching plate 230 moves forwards to close the collection path 232 and loads the coating liquid (recording liquid and undercoating liquid) on the upper surface thereof so that the coating liquid is caused to flow downwards, thereby leading the coating liquid to the drum 16A. The coating liquid which is unnecessary before and after the image formation is led to the coating liquid collection path 232 by opening the collection switching plate 230. In this manner, before applying the coating liquid to the drum 16A, the collection switching plate 230 is opened to make collection possible, thereby enabling the coating liquid collecting operation with the good responsibility. Further, the structure is simplified to be suitable for downsizing.

Incidentally, when forming a final image whose width is smaller than an effective recording width of the recording head 10F, it is satisfactory to extrude the coating liquid (the image forming liquid, the clear liquid and the undercoating liquid) for the necessary width. Therefore, it is desirable to selectively extrude the liquid from only the portion corresponding to the width of the recording area of the final image by closing the control valve so as not to extrude the unnecessary liquid from the extruding ports. Additionally, the openings for extruding clear liquid and/or undercoating liquid are grouped into a plurality of extrusion blocks in the width direction so as to extrude the liquid only in the block corresponding to the recording area of the image. By doing so, the load of the blade 220 (see FIG. 13) or the collection switching plate 230 for removing/collecting the unnecessary liquid can be reduced and the burden of cleaning the image receiving medium 16A can be also decreased.

Eighth Embodiment

Figure 17:
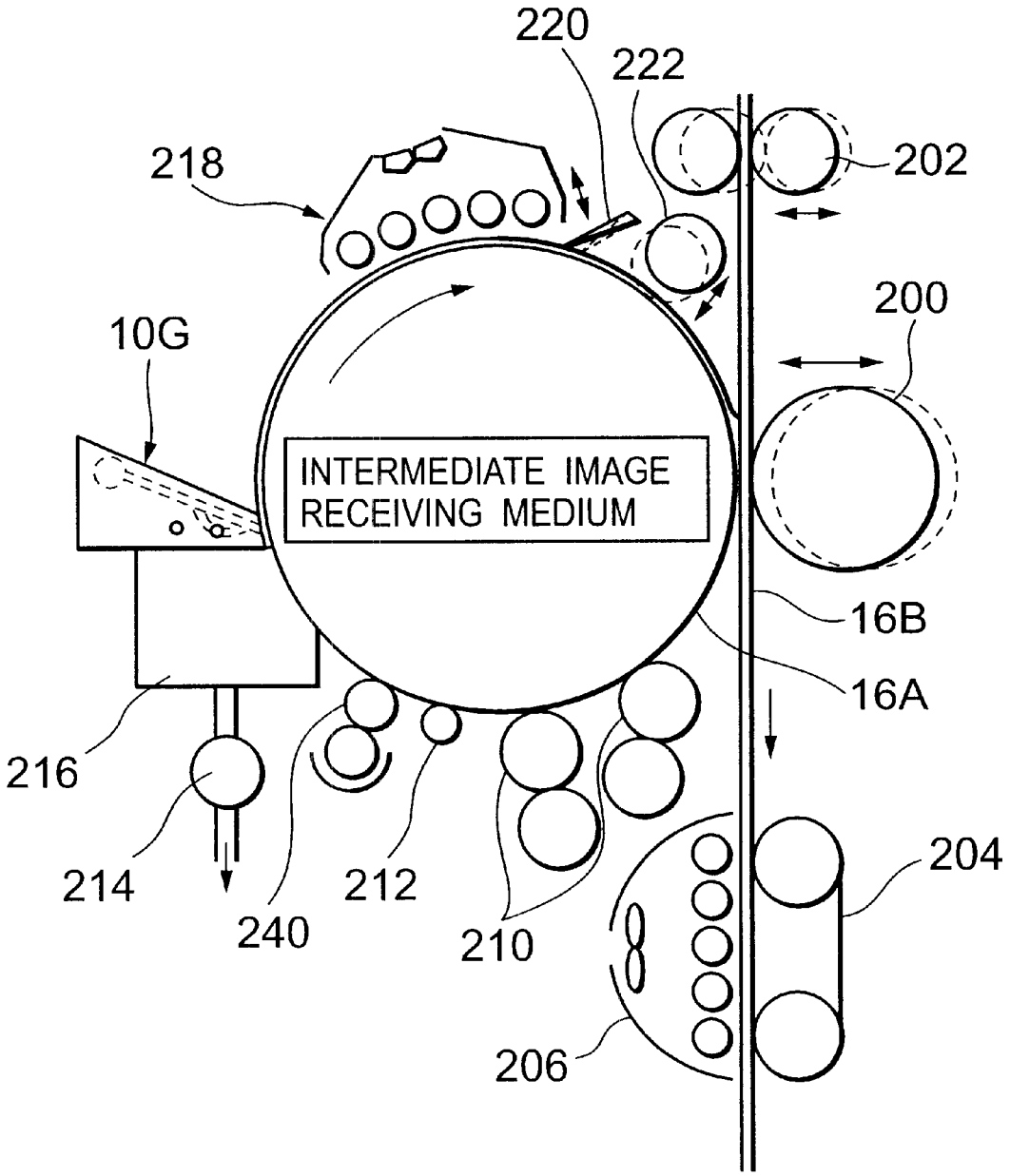
FIG. 17 is a diagram schematically showing a coating apparatus according to a eighth embodiment of the present invention.

FIG. 17 is a view schematically showing a coating apparatus according to a eighth embodiment. This embodiment adopts the slide coating mode similar to that illustrated in FIG. 13. In FIG. 17, like reference numeral denote parts similar to those in FIG. 13, thereby omitting tautological explanation. A difference from the embodiment shown in FIG. 13 is that an undercoating liquid applying roller 240 which rolls in contact with the intermediate image receiving medium or drum 16A is provided to the recording head 10G in place of the opening for extruding undercoating liquid 14E of FIGS. 14 to 16.

The undercoating liquid applying roller 240 rolls in contact with the drum 16A on the upstream side of the suction chamber 216 to apply the undercoating liquid. As mentioned above, in order to smoothly separate the coating liquid (recording liquid) from the surface of the drum 16A, the undercoating liquid is set in such a manner that its adhesion with respect to the surface of the drum 16A becomes sufficiently small or the cohesion in the undercoating liquid becomes sufficiently small.

Ninth Embodiment

Figure 18:
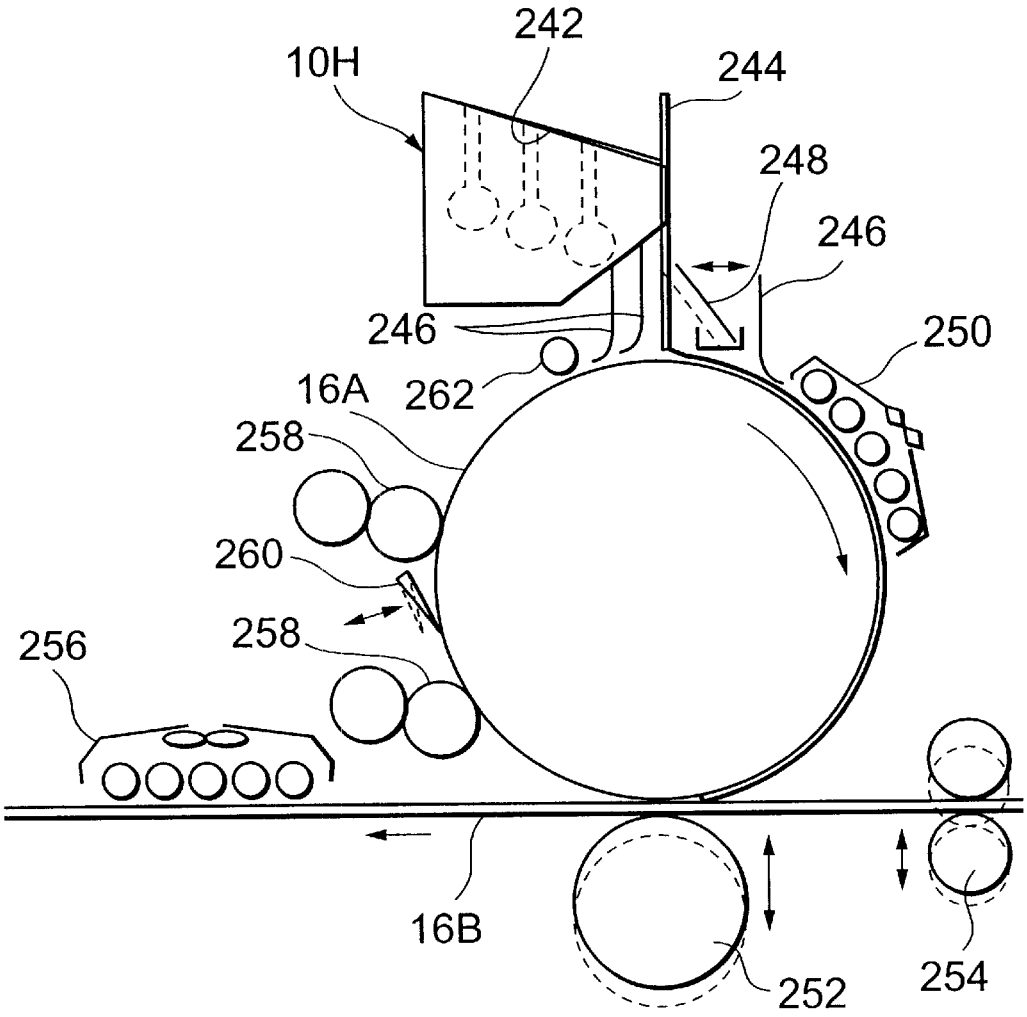
FIG. 18 is a diagram schematically showing a coating apparatus according to a ninth embodiment of the present invention.

FIG. 18 is a view schematically showing a coating apparatus according to a ninth embodiment. This embodiment shows the curtain coating mode. A recording head 1OH used herein is constituted as similar to the recording heads 10E to 10G in the slide coating mode explained in connection with FIGS. 13 to 17.

Specifically, the coating liquid (recording liquid) is loaded onto a sloped surface 242 which inclines in one direction on the upper surface of the recording head 10H and flows down toward the upper side of the intermediate image receiving medium or drum 16A. A guide plate 244 is substantially-vertically opposed to the lower edge of the sloped surface 242 in contiguity therewith. Therefore, the coating liquid moves from the lower edge of the sloped surface 242 to-the guide plate 244 and flows down to be led to the drum 16A. It is to be noted that edges for restricting a change in coating width of the recording head 10H are formed to the guide plate 244 on the both peripheries. In other words, when the coating liquid flows down along the surface of the guide plate 244, the coating liquid is centered due to the surface tension thereof, which results in reduction in thickness of the coating liquid layer on the both sides. However, formation of the edges can prevent the width from being changed. Further, in order to prevent the coating liquid from shaking by the air stream when the coating liquid is flowing down from the lower edge of the guide plate 244 to the drum 16A, a windshield plate 246 surrounds this portion.

A blade 248 which can be brought into contact with and separated from the guide plate 244 is provided. This blade 248 comes into contact with the drum 16A when removing and collecting the coating liquid which is unnecessary for the image formation. Reference numeral 250 designates a preliminary drying heater; 252, a pressure roller; 254, a guide roller; 256, a drying heater; 258, a cleaning roller; 260, a blade; and 262, a heater.

Tenth Embodiment

Figure 19:
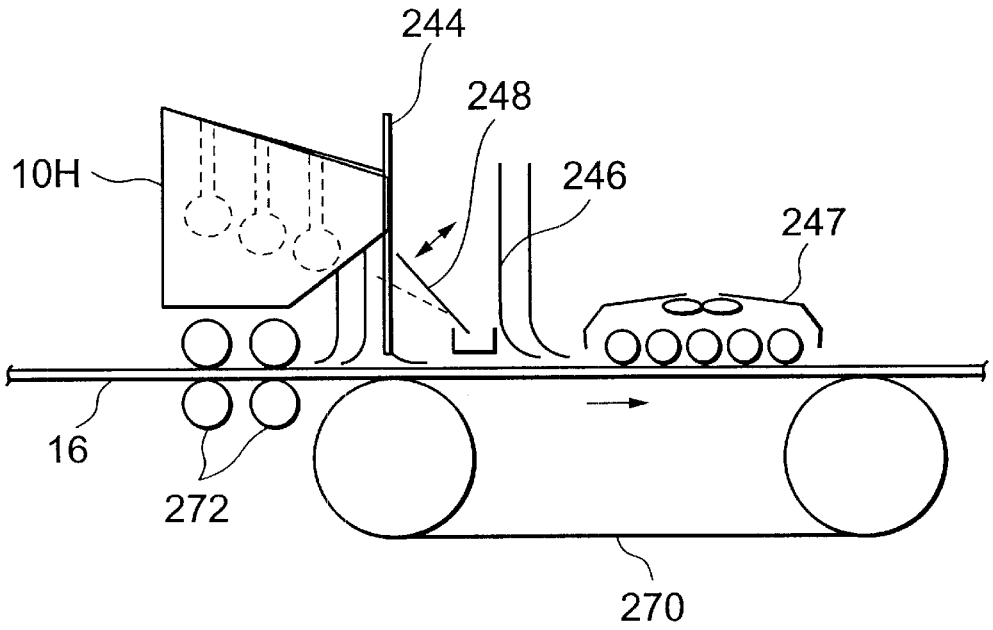
FIG. 19 is a diagram schematically showing a coating apparatus according to a tenth embodiment of the present invention.

FIG. 19 is a view schematically showing a coating apparatus according to a tenth embodiment. This embodiment employs the curtain coating mode as similar to the ninth embodiment illustrated in FIG. 18, but it is different from the embodiment of FIG. 18 in that the coating liquid flowing down from the guide plate 244 is directly led to a final image receiving medium 16 such as a recording sheet without using the intermediate image receiving medium 16A (see FIG. 18).

That is, the final image receiving medium 16 such as recording paper is fed at a fixed speed by a guide belt 270 and a guide roller 272 under the guide plate 244. The coating liquid flowing down from the guide plate 244 is led to the image receiving medium 16 and dried out by a heater 247. According to this embodiment, application of the coating liquid at high speed is possible as similar to the embodiment depicted in FIG. 18, thus enabling the high-speed image formation.

Eleventh Embodiment

Figure 20:
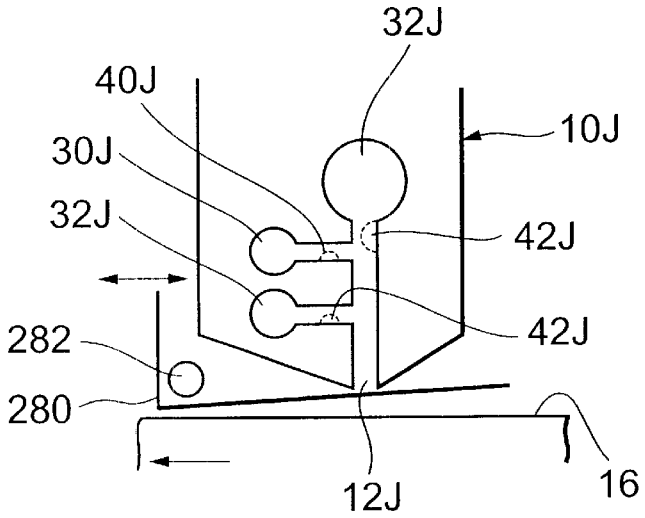
FIG. 20 is a cross sectional view showing a recording head according to an eleventh embodiment of the invention.

FIG. 20 is a cross-sectional view showing a recording head according to an eleventh embodiment. This recording head 10J includes aligned coating liquid extruding ports 12J which are opened in the downward direction. The final image receiving medium (the recording sheet) 16 is contiguous to the lower portion of the array of the extruding ports 12J and fed at predetermined intervals. A switching plate 280 as coating liquid collecting means is retractably provided between the array of the extruding ports 12J and the recording sheet 16.

That is, the collection switching plate 280 is elongated in the width direction of the recording head 10J, and its one edge entering under the aligned extruding ports 12J has a thin plate shape while the other edge is upwardly bent in the form of L. Further, the top surface of the switching plate 280 is downwardly inclined from the plate edge to the L-shaped bent portion. In addition, a coating liquid suction opening 282 which extends in the width direction of the recording head 10J is formed to the inner side of the L-shaped bent portion.

Therefore, when the plate end of the collection switching plate 280 is caused to enter under the extruding ports 12J, the coating liquid extruded from the respective ports 12J flows toward the L-shaped bent portion on the collection switching plate 280. The coating liquid is then sucked from the suction opening 282 to be removed and collected. When the collection switching plate 280 is recessed from the lower side of the extruding ports 12J, the coating liquid extruded from the ports 12J is applied onto the recording sheet 16 to form an image.

Each of the foregoing embodiments has been typically described as to the so-called slot coating mode, slide coating mode and curtain coating mode, but the present invention is not restricted thereto. For example, a composition or modification of these embodiments may be used.

When the recording head is not used for a long time, evaporation of the solvent in the liquid causes deposition and precipitation hardening of the solute. Consequently, there occurs such a problem as that the formed residue deposite clots the extruding port and the feed path of the liquid in the recording head. In order to avoid this problem, it is desirable to flush a cleaning liquid for cleaning the recording head upon completing the use. Further, when the recording head is not used, a large advantage can be obtained by putting a cover on the surface of the recording head (the sloped surface in particular) to prevent the liquid from being in contact with the outside air. Although liquid for dissolving solid components contained in the coating liquid is desirable as the cleaning liquid, it is possible to impart this function to the undercoating liquid or the clear liquid which become substantially transparent after dried out.

It is effective for the uniform coating to control so as to equally set a temperature of the coating liquid such as the image forming liquid, the clear liquid or the undercoating liquid, a temperature of the recording head and an environmental temperature on the periphery of the recording head. In a case that the slot coating mode is employed, it is effective for the uniform coating to set a temperature of the intermediate or final image receiving medium to be equal to a temperature of the coating liquid or the recording head. When replacing the coating liquid during the operation, it is preferable to provide a heat exchanging portion in a coating liquid storage tank or in the middle part of a coating liquid supplying channel in such a manner that the coating liquid can have a predetermined temperature before reaching the recording head.

The above embodiment has been described with regard to the formation of the image. That is to say, the technique of two-dimensionally drawing the image on a paper or a film has been described. However, the present invention can be applied to the manufacture of a mosaic filter for use in an image display such as a liquid crystal color display, that is to say, a color filter in which the colors of yellow, magenta and cyan are arranged in a mosaic pattern. In addition, the present invention can also be applied to the manufacture of an industrial product for forming a spatially repeated pattern.

As described above, according to the present image forming method, a plurality of types of coating liquid are combined to form a recording liquid and extruded as a continuous flow from a plurality of extruding ports which are aligned in a direction (the width direction) substantially orthogonal to a relative movement direction of the image receiving medium to continuously apply the recording liquid of plural coating liquids to the image receiving medium. Therefore, the high-speed image formation is enabled with a reduced amount of ink to be wasted. Since formation of the electric field which differs in accordance with each pixel is not necessary, dimension of the extruding nozzle can be reduced. The distortion of the image is not generated due to interaction between the ink droplets such as that observed in the ink jet mode or any adverse effect is not caused in the installation environment, thus reducing the influence of the thickness or the surface state of the image receiving medium to stably form an image.

The extruding ports can be divided and arranged for each pixel. A plurality of types of coating liquid from the respective extruding ports can be superimposed in a direction of the thickness of coating to provide a continuous flow. Further, a plurality of types of coating liquid can be integrated in a direction along the array of the extruding ports to be extruded in the form of zonation. In this case, the extruding port for each pixel is formed in and faced to the slot-shaped opening, and the multiple flows of coating liquid are integrated to be zonated in the slot-shaped opening.

At least one type of the coating liquid is determined as the clear liquid which becomes substantially transparent when dried out, and the density of the image can be changed by maintaining a volume flow rate of the entire coating liquid which is a mixture of the clear liquid and the image forming liquid substantially constant and varying a proportion of the mixture. Furthermore, at least one clear liquid is fed at a substantially constant feed pressure irrespective of an image signal, and an extrusion amount of the other coating liquid to be mixed with this clear liquid may be controlled to thereby change the extrusion amount of this clear liquid. Multiple flows of coating liquid can be smoothly applied under the equal conditions by reducing differences in specific gravity, surface tension and temperature of these flows of coating liquid.

When the outermost layer of the coating liquid extruded from the extruding port is constituted by the clear liquid, this outermost layer can be used as the undercoating liquid to improve the state of the surface of the image receiving medium for enhancing the image quality or improve the separability of the coating liquid from the intermediate image receiving medium. In case of using the intermediate image receiving medium, which temporarily holds the coating liquids layer, when the adhesion or cohesion of the coating liquid contacting with the surface of the intermediate image receiving medium is set to be smaller than the adhesion or cohesion between other layers of the coating liquid, the coating liquids can be smoothly moved from the intermediate image receiving medium to the final image receiving medium.

With respect to a small interval between pixels, it is satisfactory to bias the adjacent extruding ports in the relative movement direction of the image receiving medium. In this case, the image signal for each pixel is subjected to temporal compensation in accordance with this bias to prevent the distortion of the image. The application of the coating liquid is continuously carried out to enable the stable image formation by continuously extruding the loquid. For example, the clear liquid may be continuously extruded in a period during which an image is not formed. In such a case, it is desirable to remove and collect the unnecessary coating liquid from a portion between the extruding port and the image receiving medium.

Moreover, according to the present invention, it is possible to obtain an image forming apparatus which is directly used in implementation of the image forming method. The coating liquid extruding ports can be provided for respective pixels aligned in the width direction of the image receiving medium. The production of the recording head can be facilitated by providing and grouping the extruding ports for one pixel along a direction of movement of the image receiving medium. When the extruding ports for adjacent pixels are biased each other in a direction of movement of the image receiving medium, an interval between the adjacent extruding ports can be expanded to enhance the producibility of the recording head.

When the respective coating liquid extruding ports are formed to the slot-shaped opening to become continuous in the width direction, the coating liquids can be superimposed in the zonal shape to be smoothly extruded. By providing in the recording head a slot-shaped opening which zonally extrudes a predetermined amount of coating liquid that does not vary in response to the image signal, an appropriate type of liquid such as the undercoating liquid can be smoothly supplied in a simple structure. The recording head can be constituted in accordance with the slot coating mode, the slide coating mode, the curtain coating mode and other various kinds of coating mode. Additionally, means for removing and collecting the coating liquid in the middle of process can be provided and, in this case, further stable image formation is possible by continuously extruding the coating liquid.

When the image receiving medium is a sheet or film such as paper, a flow of the coating liquid may be directly supplied to this medium by the recording head. Alternatively, the coating liquid can be transferred to the final image receiving medium such as paper through the intermediate image receiving medium. In this case, execution of a preliminary treatment for stabilizing the state of the surface of the intermediate image receiving medium can suppress the affection of fluctuation in the state of the surface of the final image receiving medium, thereby enabling the image formation having the further improved quality.

The extrusion amount controlling means can be formed by the extrusion amount control valve provided in the passage extending from the feed path for supplying coating liquid to the coating liquid extruding port. In addition, this extrusion amount controlling means may be a pump provided for each extruding port to control an amount of extrusion.

What is claimed is:

1. An image forming method for forming an image on an image receiving medium with a plurality of coating liquids, comprising the steps of:

a) providing an array of extruding ports aligned in a direction substantially orthogonal to a relative movement direction of the image receiving medium;

b) combining said coating liquids extruded in each of the extruding ports to form a recording liquid and extruding said recording liquid from each of said extruding ports, a mixing ratio of said coating liquids in the recording liquid being varied based on an image signal; and c) transferring said recording liquid to said image receiving medium as a continuous flow while said image receiving medium is moved in the relative movement direction with respect to said extruding ports;

whereby a laminar flow of said recording liquid having layers of the coating liquids is continuously applied on said image receiving medium to form the image.

2. The image forming method according to claim 1, wherein said extruding ports are arranged in such a manner that each extruding port corresponds to respective pixels aligned in a direction substantially orthogonal to the relative movement direction of said image receiving medium; and wherein the coating liquids in said recording liquid are superimposed in a direction of coating thickness and the coating liquids extruded from the array of the extruding ports are integrated in a direction of the array of the extruding ports so that said recording liquid is zonally transferred to said image receiving medium.

3. The image forming method according to claim 1, wherein at least one of said coating liquids is a clear liquid which is substantially transparent when dried out, and a density of the image is changed by varying a proportion of the mixture of said clear liquid and at least one other coating liquid having an optical density while maintaining a volumetric flow rate of the recording liquid substantially constant.

4. The image forming method according to claim 1, wherein at least one of said coating liquids is a clear liquid which is substantially transparent after drying, and the clear liquid is fed at a substantially constant feed pressure irrespective of the image signal.

5. The image forming Method according to claim 1, wherein said coating liquids are independently variable with respect to at least one of viscosity, specific gravity, surface tension and temperature.

6. The image forming method according to claim 1, wherein said recording liquid is a laminar flow consisting of respective layers of said coating liquids; and wherein coating liquid in an uppermost or lowermost layer of the laminar flow is clear liquid which is substantially transparent when dried out.

7. The image forming method according to claim 6, wherein said clear liquid is an undercoating liquid which comes into contact with a surface of said image receiving medium.

8. The image forming method according to claim 1, said method further comprising transferring said recording liquid from said image receiving medium, said image receiving medium being an intermediate image receiving medium, to a final image receiving medium, wherein said recording liquid is a laminar flow consisting of respective layers of said coating liquids.

9. The image forming method according to claim 8, wherein at least one of said coating liquids is an undercoating liquid which is substantially transparent when dried out and said undercoating liquid is positioned in an outermost layer of said recording liquid that comes into contact with a surface of said intermediate image receiving medium.

10. The image forming method according to claim 8, wherein adhesion between said intermediate image receiving medium and one of said coating liquids that comes into contact therewith is set so as to be smaller than any cohesion in or between said coating liquids and adhesion between said final image receiving medium and another of said coating liquids that comes into contact therewith.

11. The image forming method according to claim 9, wherein cohesion in said undercoating liquid which comes into contact with the surface of said intermediate image receiving medium is set so as to be smaller than cohesion in or between any other type of said coating liquids and adhesion between said final image receiving medium and said coating liquid which comes into contact therewith.

12. The image forming method according to claim 1, wherein said extruding ports adjacent to each other are biased with respect to each other in a direction which is not orthogonal to the relative movement direction of said image receiving medium; and wherein said image signal for each pixel of the image is previously compensated for preventing distortion of the image.

13. The image forming method according to claim 1, wherein said coating liquids are continuously extruded from said extruding port even in a period for outputting an image signal during which no image is formed and said coating liquids which are extruded in the period for outputting the image signal during which no image is formed are removed and collected between said extruding ports and said image receiving medium.

14. An image forming apparatus for forming an image on an image receiving medium with a plurality of coating liquids, comprising:

a recording head having an array of extruding ports aligned in a direction substantially orthogonal to a relative movement direction of the image receiving medium, the respective extruding ports extruding the coating liquids and combining the coating liquids extruded to form a recording liquid, the recording liquid being transferred to the image receiving medium as a continuous flow while the image receiving medium is moved relatively to said extruding ports;

extrusion amount controlling means for controlling an amount of supply of said coating liquids fed to said respective extruding ports; and a controller for controlling a mixing ratio of said coating liquids in the recording liquid based on an image signal and determining a supply amount and a supply timing of the respective coating liquids, the determined supply amount and the supply timing being fed to said extrusion amount controlling means;

whereby said recording liquid has the mixing ratio of the coating liquids based on the image signal, and a laminar flow of said recording liquid having layers of the coating liquids is continuously applied on the image receiving medium to form the image.

15. The image forming apparatus according to claim 14, wherein said extruding ports are arranged in such a manner that the respective extruding ports correspond to each of a plurality of pixels aligned in a direction of a width of said image receiving medium.

16. The image forming apparatus according to claim 14, wherein said extruding ports are divided into respective groups, and extruding ports contained in the respective groups are provided along the relative direction of movement of said image receiving medium and corresponding to each of a plurality of pixels aligned in a direction of the width of said image receiving medium.

17. The image forming apparatus according to claim 15, wherein said extruding ports for adjacent pixels are biased with respect to each other in the relative direction of movement of said image receiving medium.

18. The image forming apparatus according to claim 16, wherein said extruding ports for adjacent pixels are biased with respect to each other in the relative direction of movement of said image receiving medium.

19. The image forming apparatus according to claim 14, wherein said recording head further comprises a slot-shaped opening arranged along a direction of the width of said image receiving medium, said slot-shaped opening combining said extruding ports associated with respective pixels and integrating the recording liquids which are extruded from said respective extruding ports to be zonally extruded in a direction of the width of said image receiving medium.

20. An image forming apparatus for forming an image on an image receiving medium with a plurality of coating liquids, comprising:

a recording head having an array of extruding ports aligned in a direction substantially orthogonal to a relative movement direction of the image receiving medium, the respective extruding ports extruding the coating liquids and combining the coating liquids extruded to form a recording liquid, the recording liquid being transferred to the image receiving medium as a continuous flow while the image receiving medium is moved relatively to said extruding ports, said recording head further including a slot-shaped opening, independently formed from said extruding ports, extrusion amount controlling means for controlling an amount of supply of said coating liquids fed to said respective extruding ports; and a controller for controlling a mixing ratio of said coating liquids in the recording liquid based on an image signal and determining a supply amount and a supply timing of the respective coating liquids, the determined supply amount and the supply timing being fed to said extrusion amount controlling means;

whereby said recording liquid having the mixing ratio of the coating liquids based on the image signal is continuously applied on the image receiving medium to form the image, said slot-shaped opening constantly extruding a predetermined amount of a coating liquid irrespective of the image signal in a zonated form which extends in a direction of a width of said image receiving medium.

21. The image forming apparatus according to claim 14, wherein said extruding ports are formed on a top surface of said recording head; and wherein said image receiving medium moves in such a manner that a bottom surface thereof is opposed to the top surface of said recording head.

22. The image forming apparatus according to claim 14, wherein said extruding ports are formed on a bottom surface of said recording head; and wherein said image receiving medium moves in such a manner that a top surface thereof is opposed to the bottom surface of said recording head.

23. The image forming apparatus according to claim 14, further comprising:

the recording head having a sloped surface on a top surface thereof, the sloped surface being inclined so as to lower toward said image receiving medium and having a horizontal lower edge thereof in the width direction being opposed to said image receiving medium in close proximity thereto; and the extruding ports being formed on said sloped surface so that the recording liquid extruded from each of said extruding ports flows down on said sloped surface to be led to said image receiving medium.

24. The image forming apparatus according to claim 14, further comprising:

a top surface of said recording head having a sloped surface which is inclined so as to lower toward one side and whose lower edge is horizontal, said extruding ports being formed on said sloped surface so that the recording liquid extruded from each of said extruding ports flows downward along said sloped surface to be led to the lower edge of the sloped surface; and a guide plate for guiding the recording liquid from the lower edge of said sloped surface in the downward direction to be led to said image receiving medium.

25. The image forming apparatus according to claim 14, further comprising coating liquid collecting means for removing and collecting the coating liquids in a portion between said recording head and a surface of said image receiving medium.

26. The image forming apparatus according to claim 14, wherein said image receiving medium is a sheet-type final image receiving medium.

27. The image forming apparatus according to claim 14, wherein said image receiving medium is an intermediate image receiving medium for temporarily holding the recording liquid supplied from said recording head and further transferring the recording liquid to a final image receiving medium.

28. The image forming apparatus according to claim 14, wherein said extrusion amount controlling means is formed by a control valve provided in a passage extending from a feed path for supplying coating liquid and the respective extruding ports.

29. The image forming apparatus according to claim 14, wherein said extrusion amount controlling means is formed by a pump which can change a supply amount of the coating liquid.

30. The image forming method according to claim 14, wherein at least one of said coating liquids is a clear liquid which is substantially transparent after drying, the clear liquid being fed at a substantially constant feed pressure irrespective of the image signal; and wherein an extrusion amount of the other coating liquid is controlled on the basis of the image signal by said extrusion amount controlling means.

31. An image forming method for forming an image on an image receiving medium with a plurality of coating liquids, comprising the steps of:

a) providing an array of extruding ports aligned in a direction substantially orthogonal to a relative movement direction of the image receiving medium;

b) combining said coating liquids extruded in each of the extruding ports to form a recording liquid and extruding said recording liquid from each of said extruding ports, a mixing ratio of said coating liquids in the recording liquid being varied based on an image signal; and c) transferring said recording liquid to said image receiving medium as a continuous flow while said image receiving medium is moved in the relative movement direction with respect to said extruding ports;

whereby said recording liquid is continuously applied on said image receiving medium to form the image and wherein at least one of said coating liquids is a clear liquid which is substantially transparent after drying, and the clear liquid is fed at a substantially constant feed pressure irrespective of the image signal.

32. An image forming apparatus for forming an image on an image receiving medium with a plurality of coating liquids, comprising:

a recording head having an array of extruding ports aligned in a direction substantially orthogonal to a relative movement direction of the image receiving medium, the respective extruding ports extruding the coating liquids and combining the recording liquid, the recording liquid being transferred to the image receiving medium as a continuous flow while the image receiving medium is moved relatively to said extruding ports;

extrusion amount controlling means for controlling an amount of supply of said coating liquids fed to said respective extruding ports; and a controller for controlling a mixing ratio of said coating liquids in the recording liquid based on an image signal and determining a supply amount and a supply timing of the respective coating liquids, the determined supply amount and the supply timing being fed to said extrusion amount controlling means;

whereby said coating liquid having the mixing ratio of the coating liquids based on the image signal is continuously applied on the image receiving medium to form the image;

wherein at least one of said coating liquid is a clear liquid which is substantially transparent after drying, the clear liquid being fed at a substantially constant feed pressure irrespective of the image signal.

* * * * *